US009549603B2

(12) United States Patent
Ohba et al.

(10) Patent No.: US 9,549,603 B2
(45) Date of Patent: Jan. 24, 2017

(54) CARTRIDGE-TYPE COSMETIC CONTAINER

(71) Applicant: SUZUNO KASEI KABUSHIKI KAISHA, Tokyo (JP)

(72) Inventors: Atsushi Ohba, Tokyo (JP); Tomoya Minamino, Tokyo (JP)

(73) Assignee: SUZUNO KASEI KABUSHIKI KAISHA, Tokyo (JP)

( * ) Notice: Subject to any disclaimer, the term of this patent is extended or adjusted under 35 U.S.C. 154(b) by 119 days.

(21) Appl. No.: 14/432,565

(22) PCT Filed: Sep. 20, 2013

(86) PCT No.: PCT/JP2013/075426

§ 371 (c)(1),
(2) Date: Mar. 31, 2015

(87) PCT Pub. No.: WO2014/054433

PCT Pub. Date: Apr. 10, 2014

(65) Prior Publication Data

US 2015/0245697 A1 Sep. 3, 2015

(30) Foreign Application Priority Data

Oct. 3, 2012 (JP) ..... 2012-221153
May 20, 2013 (JP) ..... 2013-106319

(51) Int. Cl.
*A45D 40/12* (2006.01)
*A45D 40/00* (2006.01)
(Continued)

(52) U.S. Cl.
CPC ..... *A45D 40/04* (2013.01); *A45D 40/00* (2013.01); *A45D 40/16* (2013.01); *A45D 2040/0056* (2013.01)

(58) Field of Classification Search
CPC ..... A45D 40/26; A45D 40/04; A45D 40/00; A45D 40/16
(Continued)

(56) References Cited

U.S. PATENT DOCUMENTS 3,468,612 A * 9/1969 Aston ..... A45D 40/262 132/320
4,993,857 A * 2/1991 Ohba ..... A45D 40/04 401/175
(Continued)

FOREIGN PATENT DOCUMENTS

JP 61-151609 U 9/1986
JP 03-049611 Y2 10/1991
(Continued)

*Primary Examiner* — Mark A Laurenzi
*Assistant Examiner* — Thomas M Abebe
(74) *Attorney, Agent, or Firm* — Rabin & Berdo, P.C.

(57) ABSTRACT

A cartridge-type cosmetic container includes: a main body outer tube to which a cartridge body is attached; a driver body that is rotatable relative to the main body outer tube; a push rod that is propelled by relative rotations of the main body outer tube and the driver body; and a screw spring that is housed in the main body outer tube, and contracts as a result of attaching the cartridge body. The screw spring includes: a first flat plate part whose position is defined in the main body outer tube; a second flat plate part that approaches the first flat plate part by the cartridge body attached; plate spring parts that join both of the flat plate part each other; and a female thread protuberance that is provided on the plate spring parts, and interlocks with a male thread of the push rod as the plate spring parts curve.

12 Claims, 26 Drawing Sheets

(51) Int. Cl.

| | |
|---|---|
| ***A45D 40/04*** | (2006.01) |
| ***B43K 21/08*** | (2006.01) |
| ***A45D 40/26*** | (2006.01) |
| ***A45D 40/16*** | (2006.01) |

(58) Field of Classification Search
USPC ..... 401/75, 170–180, 122
See application file for complete search history.

(56) References Cited

U.S. PATENT DOCUMENTS

| | | | | | |
|---|---|---|---|---|---|
| 4,997,299 | A * | 3/1991 | Ohba | A45D 40/00 | 401/171 |
| 5,085,352 | A * | 2/1992 | Sasaki | A45D 40/04 | 222/327 |
| 5,816,727 | A * | 10/1998 | Ohba | A45D 40/04 | 401/68 |
| 6,082,372 | A * | 7/2000 | Mizukaki | A45D 40/06 | 132/318 |
| 6,309,121 | B1 * | 10/2001 | Ohba | A45D 40/04 | 401/75 |
| 6,331,084 | B1 * | 12/2001 | Ohba | A45D 40/04 | 401/68 |
| 6,371,673 | B1 * | 4/2002 | Gueret | A45D 40/04 | 401/31 |
| 6,543,952 | B1 * | 4/2003 | Ohba | A45D 40/04 | 401/174 |
| 6,918,511 | B1 * | 7/2005 | Spatz | A45D 40/26 | 222/109 |
| 7,686,192 | B1 * | 3/2010 | Patton | A45D 40/04 | 222/390 |
| 2003/0031497 | A1 * | 2/2003 | Ohba | A45D 40/04 | 401/88 |
| 2006/0198688 | A1 * | 9/2006 | Ohba | A45D 40/04 | 401/88 |
| 2007/0147948 | A1 * | 6/2007 | Murakoshi | A45D 40/04 | 401/175 |
| 2014/0227018 | A1 * | 8/2014 | Baudin | A45D 34/04 | 401/55 |
| 2015/0245697 | A1 * | 9/2015 | Ohba | A45D 40/04 | 401/75 |

FOREIGN PATENT DOCUMENTS

| | | | |
|---|---|---|---|
| JP | 08-000207 | U | 2/1996 |
| JP | 09-149813 | A | 6/1997 |
| JP | 10-512483 | A | 12/1998 |
| JP | 2000-300335 | A | 10/2000 |

* cited by examiner

CARTRIDGE-TYPE COSMETIC CONTAINER

TECHNICAL FIELD

The present invention relates to a cartridge-type cosmetic container with a cartridge body, containing a cosmetic substance, detachably mounted thereon.

BACKGROUND ART

Conventionally, a cartridge-type propellant container has been used that causes a cosmetic substance in a cartridge body to come out little by little from a distal end open hole of the cartridge body. There is a cartridge-type propellant container in which a cartridge body does not have a propellant mechanism, that is to say, the propellant mechanism is provided in complete separation and independence from the cartridge body.

JP 03-049611 B2 discloses a cartridge-type airtight container in which, upon detachment of a cartridge body from a threaded part of a distal tube, a spring causes a slide shaft to move to a backward propelling limit in an outer tube, thereby allowing a new cartridge body to be mounted. In this container, once a cartridge body has been attached, a sleeve with a tapered surface closes a chuck jaw of a threaded chuck, and a thread on the inner surface of the chuck jaw and a thread on the slide shaft are screwed together. When the cartridge body is detached, the sleeve is separated from the threaded chuck due to the resilient force of the spring between the sleeve and the chuck, and the chuck jaw of the threaded chuck that was restrained on the tapered surface of the sleeve is opened due to the elasticity thereof. Consequently, the thread on the inner surface of the chuck jaw and the thread on the slide shaft are unscrewed.

SUMMARY OF INVENTION

The container according to JP 03-049611 B2 uses a complicated mechanism composed of the sleeve, the threaded chuck, and the spring to allow the slide shaft to move to the backward propelling limit upon detachment of the cartridge body. With such a complicated mechanism, the chuck jaw at the distal end of the threaded chuck is bent inward for a long period of time as a result of being restrained on the tapered surface of the sleeve. Therefore, there is a possibility that the chuck jaw cannot be opened merely by the elasticity thereof. This gives rise to the possibility that the slide shaft cannot be returned to the backward propelling limit due to the failure to unscrew the thread on the inner surface of the chuck jaw and the thread on the slide shaft.

The present invention has been made in view of the above problems. It is an object of the present invention to simplify the mechanism for causing a push rod to move to a backward propelling limit upon detachment of a cartridge body, and to cause the push rod to move to the backward propelling limit with higher reliability.

According to an aspect of the present invention, a cartridge-type cosmetic container being used with a cartridge body, containing a cosmetic substance, attached thereto, the cartridge-type cosmetic container includes a main body outer tube to which the cartridge body is detachably attached, a driver body that is coaxially attached to the main body outer tube so as to be rotatable relative to the main body outer tube, a push rod with a male thread formed on an outer circumference thereof, the push rod pushing the cosmetic substance in the cartridge body by being propelled by relative rotations of the main body outer tube and the driver body, and a screw spring housed in the main body outer tube, and contracts in an axial direction as a result of attaching the cartridge body. The screw spring includes a first flat plate part whose position in the axial direction is defined in the main body outer tube, a second flat plate part that approaches the first flat plate part as a result of attaching the cartridge body, a plurality of plate spring parts that join the first flat plate part and the second flat plate part to each other, and curve toward an inner circumferential side when contracting in the axial direction, and a female thread protuberance provided on at least one of the plurality of plate spring parts, and interlocks with the male thread as the plurality of plate spring parts curve.

DESCRIPTION OF EMBODIMENTS

The following describes embodiments of the present invention with reference to the drawings.

First Embodiment

A cartridge-type cosmetic container 1 according to a first embodiment of the present invention will now be described with reference to FIGS. 1 to 11.

Figure 1:
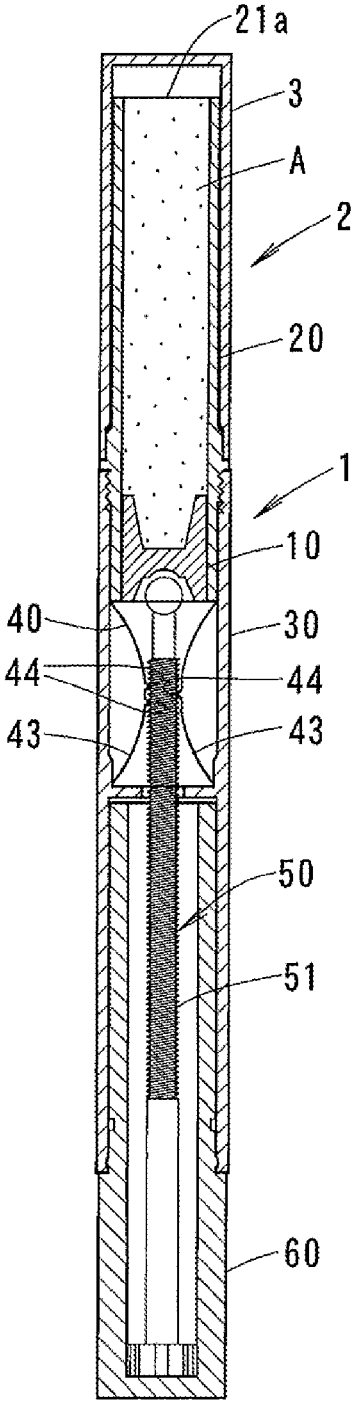
FIG. 1 is a frontal cross-sectional view of a cartridge-type cosmetic container according to a first embodiment of the present invention.

The cartridge-type cosmetic container 1 is used with a cartridge body 2, containing a cosmetic substance A, attached thereto. As shown in FIG. 1, the cartridge-type cosmetic container 1 includes a main body outer tube 30, a driver body 60, a push rod 50, and a screw spring 40. The cartridge body 2 is detachably attached to the main body outer tube 30. The driver body 60 is coaxially attached to the main body outer tube 30 so as to be rotatable relative to the main body outer tube 30. A male thread 51 is formed on the outer circumference of the push rod 50. Relative rotations of the main body outer tube 30 and the driver body 60 propel the push rod 50, thereby causing the push rod 50 to push out the cosmetic substance A in the cartridge body 2. The screw spring 40 is housed in the main body outer tube 30, and contracts in the axial direction as a result of attaching the cartridge body 2. The components for propelling the cosmetic substance A are not provided in the cartridge body 2, but are concentrated in the cartridge-type cosmetic container 1.

Figure 2A:
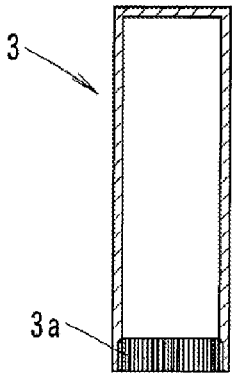
FIG. 2A is a frontal cross-sectional view of a cap of a cartridge body.
Figure 2B:
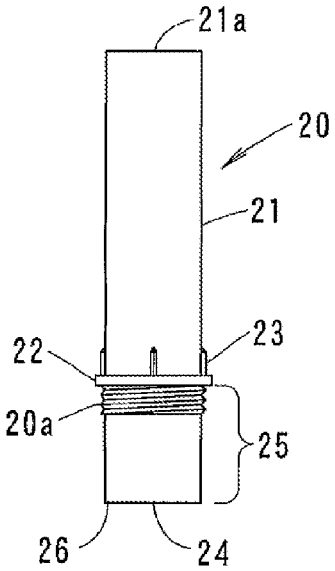
FIG. 2B is a front view of a cartridge outer tube of the cartridge body.
Figure 2C:
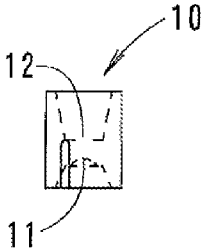
FIG. 2C is a front view of a holding member of the cartridge body.
Figure 3:
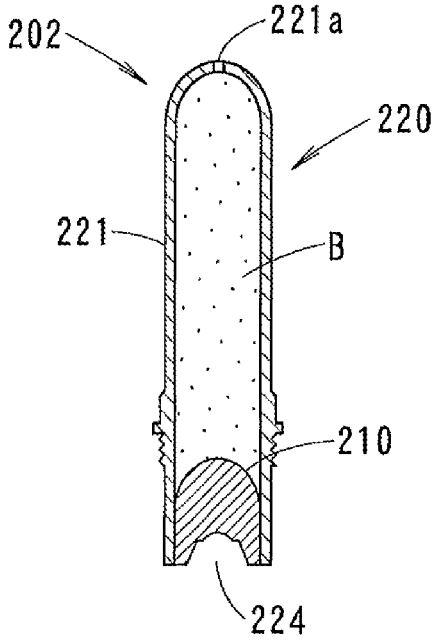
FIG. 3 is a cross-sectional view showing a modification example of the cartridge body.

First, a description is given of the cartridge body 2 that is attached to the cartridge-type cosmetic container 1 with reference to FIGS. 2A to 3.

The cartridge body 2 is attached to the main body outer tube 30 by rotating about the central axis thereof. The cartridge body 2 includes a cartridge outer tube 20, a holding member 10, and a cap 3. The cartridge outer tube 20 contains the cosmetic substance A. The holding member 10 is slidable in the axial direction in the cartridge outer tube 20. The cap 3 is attached to the cartridge outer tube 20.

The cosmetic substance A is supplied from the side of a distal end open hole 21*a* or from the side of a posterior end open hole 24 depending on the texture thereof. Furthermore, the cosmetic substance A is supplied in a heated state, and the supplied cosmetic substance A turns into a gel or a stick when cooled down.

As shown in FIG. 2B, the cartridge outer tube 20 includes a cosmetic holding part 21, an insert part 25, and a flange 22. The distal end open hole 21*a* is formed in the cosmetic holding part 21. The posterior end open hole 24 is formed in the insert part 25. When attached to the main body outer tube 30, the insert part 25 is inserted and fit into the cartridge body 2. The flange 22 is provided between the cosmetic holding part 21 and the insert part 25, and projects toward the outer circumferential side.

The cosmetic holding part 21 is formed in a cylindrical shape. The cosmetic substance A is supplied to the inner circumferential side of the cosmetic holding part 21. A plurality of vertical ribs 23 that extend from the flange 22 in the axial direction are formed on the outer circumference of the cosmetic holding part 21. These vertical ribs 23 are intended to lock the cap 3 so as to disable relative rotation of the cap 3 when the cap 3 has been mounted.

The insert part 25 is formed in a cylindrical shape. The inner circumference of the insert part 25 is formed continuously with the inner circumference of the cosmetic holding part 21. Starting from the flange 22, a male thread 20*a* proceeding in the axial direction is formed on the outer circumference of the insert part 25. This male thread 20*a* is screwed into the main body outer tube 30.

When attached to the main body outer tube 30, the flange 22 comes into contact with an end portion of the main body outer tube 30 and defines a relative position in the axial direction. Furthermore, when the cap 3 has been attached, the flange 22 comes into contact with an end portion of the cap 3 and defines a relative position in the axial direction.

The holding member 10 is inserted into the inner circumference of a through-hole that penetrates the cartridge body 2 in the axial direction. The holding member 10 is positioned at the posterior end of the cosmetic substance A. As shown in FIG. 2C, the holding member 10 is formed in a substantially cylindrical shape, and includes a contact part 11 and a bottom surface 12. The push rod 50 comes into contact with the contact part 11. The cosmetic substance A is supplied to the bottom surface 12. The holding member 10 is not intended to hold the cosmetic substance A. The holding member 10 is rather intended to prevent leakage of the supplied cosmetic substance A, and also to cause the cosmetic substance A to project from the distal end open hole 21*a* with the movement of the push rod 50.

As set forth above, in the cartridge body 2, the shapes of the cartridge outer tube 20 and the holding member 10 are simple, and hence the cosmetic substance A can be supplied directly to the cartridge outer tube 20.

As shown in FIG. 2A, the cap 3 is formed in the shape of a cylinder with a bottom. The cap 3 is attached to the cosmetic holding part 21 of the cartridge outer tube 20 so as to close the distal end open hole 21*a*. Knurl ribs 3*a* that engage with the vertical ribs 23 of the cartridge outer tube 20 are formed on the inner circumference of an open end of the cap 3. When attached to the cartridge outer tube 20, the cap 3 cannot rotate relative to the cartridge outer tube 20. Therefore, if a user holds and rotates the cap 3, he/she can rotate the cartridge outer tube 20 concurrently.

It should be noted that the cap 3 may not be provided in the case where it is desired to reduce the outer diameter of the cartridge-type cosmetic container 1, and in the case where the airtightness of the cartridge body 2 is not required.

According to the cartridge body 2 configured in the above manner, once the holding member 10 has been inserted into the cartridge outer tube 20 and the cosmetic substance A has been supplied to the cartridge outer tube 20, the distal end open hole 21*a* is closed by attaching the cap 3 to the cartridge outer tube 20. In this state, the cartridge body 2 can be sold by itself as a cartridge containing the cosmetic substance A. Also, the cartridge-type cosmetic container 1 provided with the cartridge body 2 may be sold in the state where the cartridge body 2 has been attached to the cartridge-type cosmetic container 1.

Furthermore, the cartridge-type cosmetic container 1 can also use a cartridge body 202 shown in FIG. 3 in place of the foregoing cartridge body 2. According to the cartridge body 202, a liquid cosmetic substance B contained in a cartridge outer tube 220 is pushed out from a distal end dispensing hole 221*a*. This cartridge body 202 is formed by supplying the cosmetic substance B from the side of the distal end dispensing hole 221*a* using a thin nozzle after inserting a holding member 210 into the cartridge outer tube 220, or by inserting the holding member 210 after supplying the cosmetic substance B from a posterior end open hole 224. The distal end surface of the holding member 210 is formed in the shape conforming to the inner circumferential surface of a distal end of the cartridge outer tube 220. This makes it possible to use up all of the cosmetic substance B contained in the cartridge outer tube 220.

Each of the components constituting the cartridge-type cosmetic container 1 will now be described with reference to FIGS. 4 to 8.

Figure 4:
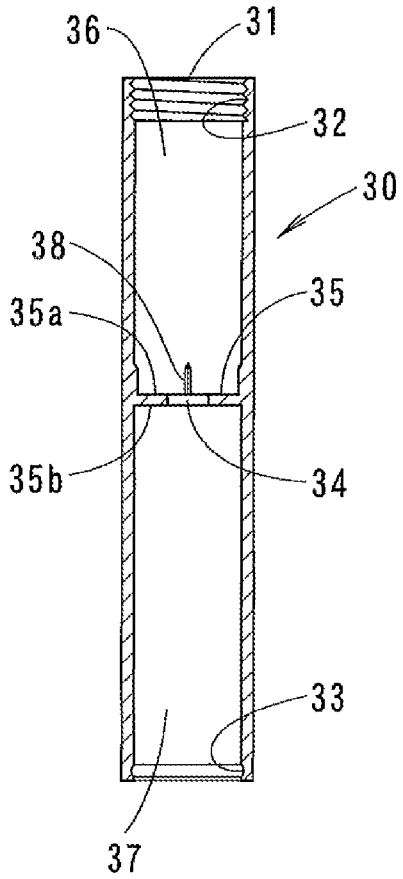
FIG. 4 is a frontal cross-sectional view of a main body outer tube.

As shown in FIG. 4, the main body outer tube 30 is formed in a cylindrical shape. The inner circumference of the main body outer tube 30 is separated into an anterior cavity part 36 and a posterior cavity part 37 by a partition wall 35 provided substantially in the middle in the axial direction. A through-hole 34 through which a shaft 55 of the push rod 50 can advance and recede is formed at the center of this partition wall 35.

The main body outer tube 30 includes a female thread 32 and a fitting recess 33. The female thread 32 is formed on the inner circumference in the vicinity of a distal end open hole 31 that is formed in an end portion of the anterior cavity part 36. The fitting recess 33 is formed in the vicinity of an end portion of the posterior cavity part 37, and is joined to the driver body 60 so as to be rotatable relative to the driver body 60.

The foregoing insert part 25 of the cartridge body 2 is inserted and fit into the anterior cavity part 36 from the distal end open hole 31. By rotating the main body outer tube 30 and the cartridge body 2 relative to each other about the central axis, the male thread 20*a* formed on the cartridge outer tube 20 of the cartridge body 2 is screwed into the female thread 32 of the main body outer tube 30. In this way, the cartridge body 2 is screwed and attached to the main body outer tube 30.

The screw spring 40 is also inserted into the anterior cavity part 36. A plurality of vertical ribs 38 that extend from the partition wall 35 in the axial direction are formed on the inner circumference of the anterior cavity part 36. These vertical ribs 38 extend in the axial direction from an upper end surface 35*a* that comes into contact with the inserted screw spring 40. The vertical ribs 38 are formed such that the inner diameter defined thereby is smaller than a later-described posterior end part 42 of the screw spring 40. In this way, once the screw spring 40 has been inserted into the anterior cavity part 36, the posterior end part 42 is held by the vertical ribs 38. Consequently, the screw spring 40 does not come off the anterior cavity part 36 even if the cartridge body 2 is detached. It should be noted that, depending on the outer diameter of the posterior end part 42, the screw spring 40 can be prevented from coming off the anterior cavity part 36 without providing the vertical ribs 38.

The fitting recess 33 is provided on the inner circumference of the posterior cavity part 37 as an annular recess. A later-described fitting protrusion 65 of the driver body 60 is fit into the fitting recess 33.

Figure 5A:
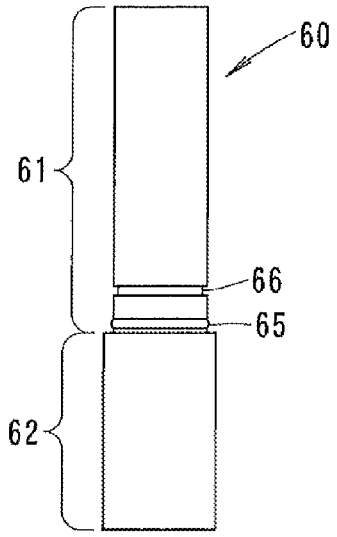
FIG. 5A is a front view of a driver body.

As shown in FIG. 5A, the driver body 60 is formed in the shape of a cylinder with a bottom. The driver body 60 includes an insert part 61, a grip 62, and a plurality of vertical ribs 63. The insert part 61 is inserted and fit into the main body outer tube 30. The grip 62 is formed continuously with the insert part 61, and gripped by the user for use. The vertical ribs 63 are formed on the inner circumference, and engage with the push rod 50 such that they cannot rotate relative to the push rod 50.

The insert part 61 is formed in a cylindrical shape. The fitting protrusion 65 that is fit into the fitting recess 33 of the main body outer tube 30 is provided as an annular protrusion on the outer circumference in the vicinity of a proximal end of the insert part 61. An annular groove 66 is also provided on the outer circumference of the insert part 61 as a recess. By inserting an O-ring into this groove 66, appropriate resistance can be applied to relative rotations of the main body outer tube 30 and the driver body 60, thereby allowing the user to experience better maneuverability.

The grip 62 is formed such that the diameter thereof is larger than the diameter of the insert part 61 and is substantially the same as the outer diameter of the main body outer tube 30. In this way, when the driver body 60 is coupled to the main body outer tube 30, the outer circumferential surface of the main body outer tube 30 is substantially flush with the outer circumferential surface of the grip 62.

Figure 5B:
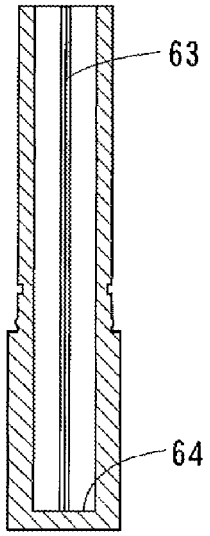
FIG. 5B is a cross-sectional view related to FIG. 5A.
Figure 5C:
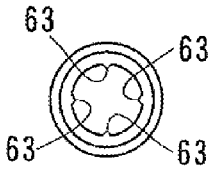
FIG. 5C is a plan view related to FIG. 5A.

As shown in FIGS. 5B and 5C, the vertical ribs 63 extend in the axial direction from a bottom surface 64 to an open end of the inner circumference. The vertical ribs 63 engage with later-described guiding grooves 56 of a large diameter part 54 of the push rod 50. In the present embodiment, four vertical ribs 63 are provided.

Figure 6A:
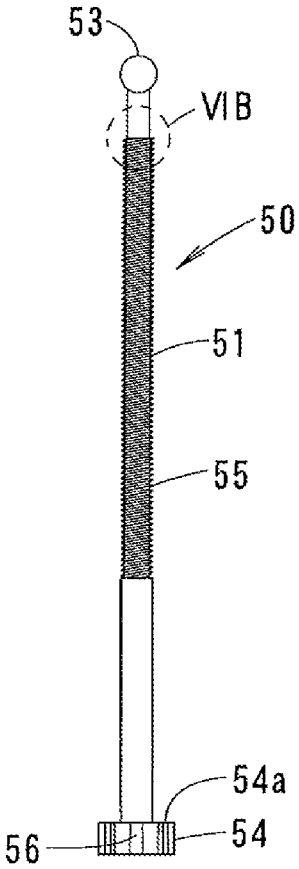
FIG. 6A is a front view of a push rod.

As shown in FIG. 6A, the push rod 50 is formed in a substantially columnar shape. The push rod 50 is housed in the inner circumferential side of the main body outer tube 30 and the driver body 60. The push rod 50 includes the shaft 55, an anterior end part 53, and the large diameter part 54. The shaft 55 is provided coaxially with the main body outer tube 30 and the driver body 60. The anterior end part 53 is provided at one end of the shaft 55. The large diameter part 54 is provided at the other end of the shaft 55.

Figure 6B:
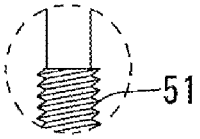
FIG. 6B is an enlarged view of a portion VIB shown in FIG. 6A.

As shown in FIG. 6B, the male thread 51, which is a single-start thread with a pitch P of 0.5 [mm] and a lead L of 0.5 [mm], is formed on the outer circumference of the shaft 55. The cosmetic substance A contained in the cartridge body 2 and the cosmetic substance B contained in the cartridge body 202 are pushed out little by little for use. Therefore, the pitch of the male thread 51 is set so as to allow the push rod 50 to move little by little. However, no limitation is intended in this regard. The male thread 51 may be a single-start thread with a pitch P of 1.0 [mm] and a lead L of 1.0 [mm], or may be a double-start thread with a pitch P of 1.0 [mm] and a lead L of 2.0 [mm].

A later-described female thread protuberance 44 of the screw spring 40 can interlock with the male thread 51. A stroke of the push rod 50 is determined by the length of the male thread 51 in the axial direction.

The anterior end part 53 is formed in a spherical shape. The anterior end part 53 comes into contact with the contact part 11 of the holding member 10 of the cartridge body 2. In this way, when the push rod 50 moves in the axial direction, the anterior end part 53 presses the holding member 10, and the cosmetic substance A in the cartridge body 2 is pushed out from the distal end open hole 21*a*.

The large diameter part 54 is formed to have a larger diameter than the shaft 55. The large diameter part 54 moves in the axial direction in the driver body 60. When in contact with the bottom surface 64 of the driver body 60, the large diameter part 54 defines a backward propelling limit of the push rod 50. The plurality of guiding grooves 56, which engage with the vertical ribs 63 of the driver body 60, are provided on the outer circumference of the large diameter part 54 as recesses running in the axial direction. Relative rotations of the push rod 50 and the driver body 60 are disabled by the engagement between the guiding grooves 56 and the vertical ribs 63. Therefore, if the user grips and rotates the driver body 60, the push rod 50 rotates concurrently.

It should be noted the object of the push rod 50 is to let the cosmetic substance A in the cartridge body 2 come out little by little. To this end, in the present embodiment, the cosmetic substance A that has once come out cannot be drawn back into the cartridge body 2 by causing the push rod 50 to recede during use.

Figure 7A:
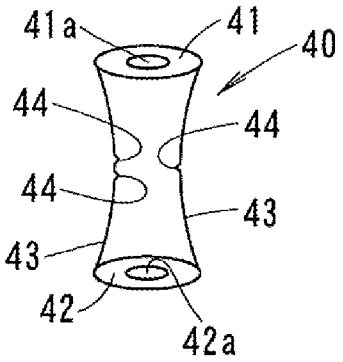
FIG. 7A is a perspective view of a screw spring.

As shown in FIG. 7A, the screw spring 40 is formed in the shape of a waisted drum. The screw spring 40 includes the posterior end part 42, an anterior end part 41, a plurality of plate spring parts 43, and the female thread protuberance 44. The posterior end part 42 serves as a first flat plate part whose position in the axial direction is defined in the main body outer tube 30. The anterior end part 41 serves as a second flat plate part that approaches the posterior end part 42 as a result of attaching the cartridge body 2. The plurality of plate spring parts 43 join the anterior end part 41 and the posterior end part 42 to each other. The female thread protuberance 44 is provided on at least one of the plurality of plate spring parts 43, and interlocks with the male thread 51 as the plate spring parts 43 curve toward the push rod 50.

The screw spring 40 is formed by bending an ultrathin stainless steel strip designed for a spring. In this way, the durability and resilience of the screw spring 40 are ensured, and the cartridge-type cosmetic container 1 can be used for a long period of time. Instead, the screw spring 40 may be formed of other materials, such as resin.

The anterior end part 41 is formed in an annular shape. The anterior end part 41 is formed such that the outer diameter thereof is smaller than the inner diameter of the anterior cavity part 36 of the main body outer tube 30. A through-hole 41*a* through which the shaft 55 of the push rod 50 can advance and recede is formed in the middle of the anterior end part 41. A posterior end surface 26 (see FIG. 2B) of the cartridge body 2 attached to the main body outer tube 30 comes into contact with the anterior end part 41. The screw spring 40 contracts as the cartridge body 2 presses the anterior end part 41 in the axial direction.

The posterior end part 42 is formed in an annular shape similar to the shape of the anterior end part 41. The posterior end part 42 is formed such that the outer diameter thereof is smaller than the inner diameter of the anterior cavity part 36 of the main body outer tube 30 and is larger than the inner diameter defined by the vertical ribs 38 formed on the anterior cavity part 36. A through-hole 42*a* through which the shaft 55 of the push rod 50 can advance and recede is formed in the middle of the posterior end part 42. The posterior end part 42 comes into contact with the upper end surface 35*a* (see FIG. 4) in the anterior cavity part 36.

Figure 7B:
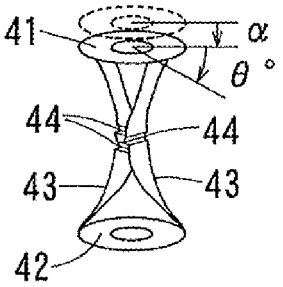
FIG. 7B is a perspective view showing the state where the screw spring has been installed in the cartridge-type cosmetic container.

When the plate spring parts 43 contract in the axial direction, they curve toward the inner circumferential side. Specifically, as shown in FIG. 7B, the plate spring parts 43 bow toward the inner circumferential side when pressed in the axial direction. Alternatively, the plate spring parts 43 may be formed so as to angularly bend toward the inner circumferential side when pressed in the axial direction.

The plate spring parts 43 are twisted by rotation when the cartridge body 2 is screwed. Specifically, when the cartridge body 2 is rotated and screwed into the main body outer tube 30 in the state where the posterior end surface 26 of the cartridge body 2 is in contact with the anterior end part 41, the plate spring parts 43 are twisted by the force of friction between the posterior end surface 26 and the anterior end part 41.

The female thread protuberance 44 is provided as a protrusion on the inner side of the plate spring parts 43 substantially in the middle in the axial direction. In the state where the cartridge body 2 is not attached, the female thread protuberance 44 is parallel to the anterior end part 41 and the posterior end part 42 as the plate spring parts 43 are not twisted.

Figure 8:
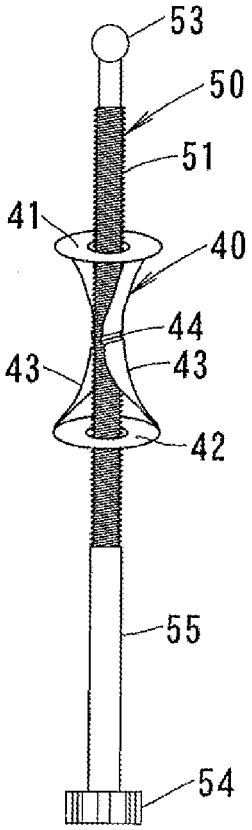
FIG. 8 shows the state where the screw spring is twisted while clinging to the outer circumference of the push rod.

Once the cartridge body 2 has been attached, as shown in FIG. 8, the female thread protuberance 44 interlocks with the male thread 51 in the state where the plate spring parts 43 are twisted by rotation of the cartridge body 2 while clinging to the outer circumference of the push rod 50. The female thread protuberance 44 is formed so as to incline in the same direction as the lead angle of the male thread 51 when the plate spring parts 43 are twisted.

In this way, the female thread protuberance 44 and the male thread 51 are screwed together with a strong screw force. Accordingly, even in the case where the cosmetic substance A contained in the cartridge outer tube 20 adheres to the inner circumference of the cartridge outer tube 20, the cosmetic substance A can be pushed out with a strong force.

As shown in FIG. 7B, the screw spring 40 is compressed by $\alpha$ [mm] and twisted by $\theta$ [deg] for use. It should be noted that no limitation is intended in this regard. The female thread protuberance 44 may interlock with the male thread 51 for use in the state where the plate spring parts 43 of the screw spring 40 are not twisted but merely bow toward the inner circumferential side by being pressed in the axial direction with a compression of $\alpha$ [mm].

As set forth above, in the screw spring 40, the posterior end part 42 is supported by the main body outer tube 30 such that it cannot turn, and the anterior end part 41 is rotated with respect to the posterior end part 42 by rotating the cartridge body 2 relative to the main body outer tube 30. Consequently, the plate spring parts 43 become twisted, thereby making the female thread protuberance 44 of the plate spring parts 43 interlock with the male thread 51 of the push rod 50.

When the cartridge body 2 is detached from the main body outer tube 30, the female thread protuberance 44 is separated from the male thread 51 as the plate spring parts 43 resume their original shape (the state of FIG. 7A). Consequently, the interlocking between the female thread protuberance 44 and the male thread 51 is dissolved.

It is sufficient to provide the female thread protuberance 44 on one of the plurality of plate spring parts 43. However, in the case where a pair of plate spring parts 43 facing each other is provided as in the present embodiment, it is preferable that the female thread protuberance 44 be formed on both of the plate spring parts 43. The plate spring parts 43 are not limited to being provided in a pair. Any number of plate spring parts 43 may be provided as long as the number is plural.

It should be noted that the top and bottom of the screw spring 40 are not fixed. Therefore, the screw spring 40 may be housed in the anterior cavity part 36 such that the anterior end part 41 comes into contact with the upper end surface 35*a* in the anterior cavity part 36 and the posterior end part 42 comes into contact with the posterior end surface 26 of the cartridge body 2. In this case, the anterior end part 41 and the posterior end part 42 serve as the first flat plate part and the second flat plate part, respectively.

The operations of the cartridge-type cosmetic container 1 will now be described mainly with reference to FIGS. 1, 9, and 10.

FIG. 1 shows the state of the cartridge-type cosmetic container 1 before use. In FIG. 1, the push rod 50 is positioned at the backward propelling limit. At this time, the screw spring 40 is pressed in the axial direction by the cartridge body 2 attached to the main body outer tube 30. Therefore, the pair of plate spring parts 43 of the screw spring 40 bows toward the inner circumferential side, and the female thread protuberance 44 provided on the plate spring parts 43 interlocks with the male thread 51 of the push rod 50.

In this state, if the user detaches the cap 3 and rotates the driver body 60 with respect to the main body outer tube 30, the push rod 50 advances due to the interlocking between the female thread protuberance 44 and the male thread 51. Consequently, the cosmetic substance A comes out from the distal end open hole 21*a* of the cartridge outer tube 20, and hence becomes usable.

Figure 9:
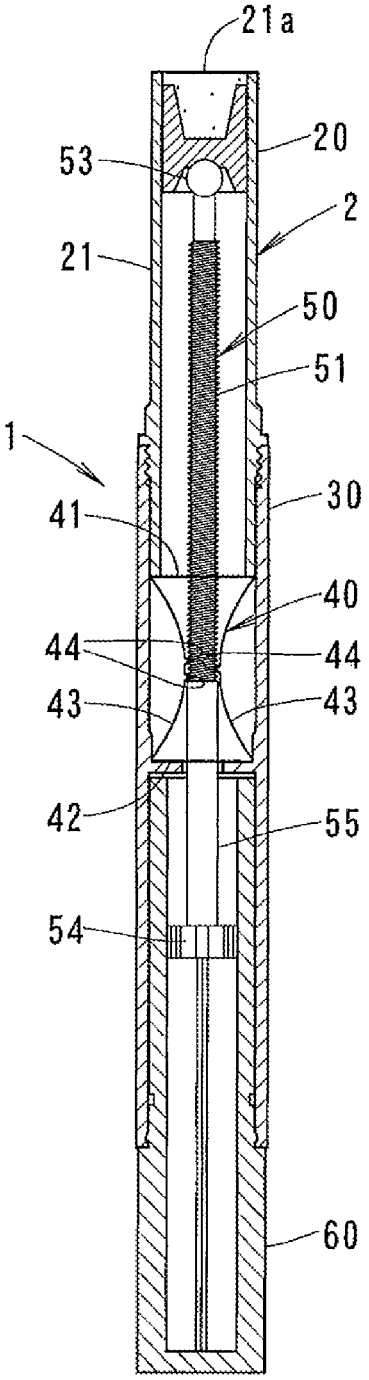
FIG. 9 shows the state where the push rod has been propelled up until a forward propelling limit in the cartridge-type cosmetic container shown in FIG. 1.
Figure 10:
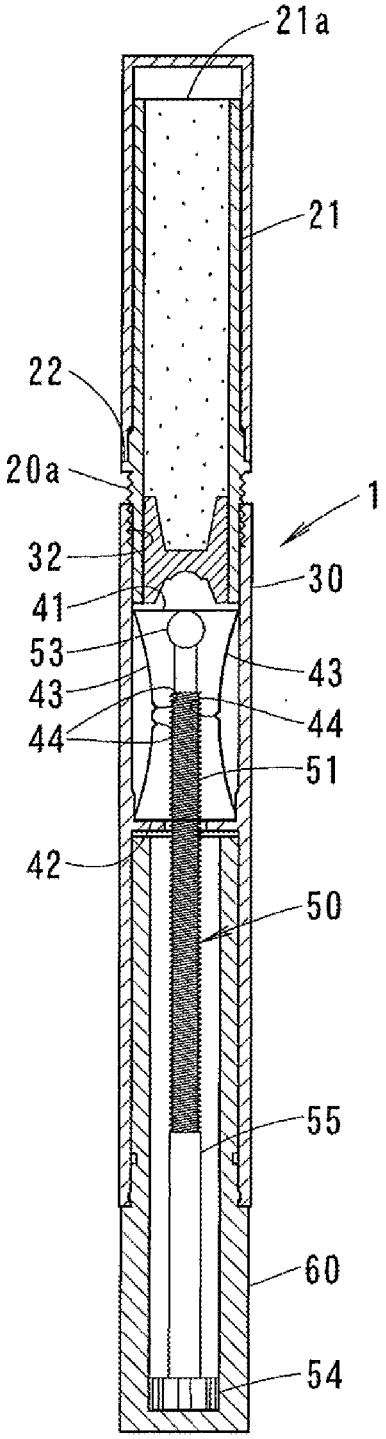
FIG. 10 shows the state where the cartridge body has been detached from the cartridge-type cosmetic container shown in FIG. 1.

If the user further keeps rotating the driver body 60 with respect to the main body outer tube 30, the push rod 50 is propelled up until a forward propelling limit as shown in FIG. 9. This forward propelling limit is defined by a stroke end of the male thread 51 formed on the shaft 55 of the push rod 50. In the state of FIG. 9, if the user further rotates the driver body 60 with respect to the main body outer tube 30, the male thread 51 freely spins as the female thread protuberance 44 is widened due to the elasticity of the plate spring parts 43. Therefore, there will be no more strokes of the push rod 50.

In addition, at this time, the holding member 10 has moved up until a forward end in the cartridge body 2. Therefore, most of the cosmetic substance A has been pushed out from the distal end open hole 21*a*. In this state, the cosmetic substance A needs to be replaced.

In the state shown in FIG. 9, if the cartridge body 2 is rotated with respect to the main body outer tube 30 in an attempt to detach the cartridge body 2 from the main body outer tube 30, the cartridge body 2 is separated from the main body outer tube 30. Consequently, as shown in FIG. 10, the screw spring 40 extends in the axial direction due to its own resilient force, and is restored to the original state. Therefore, the pair of plate spring parts 43 is separated from each other, and the interlocking between the female thread protuberance 44 of the screw spring 40 and the male thread 51 of the push rod 50 is dissolved. This renders the push rod 50 freely movable in the axial direction. In the state where the push rod 50 is standing almost upright, it moves up until the backward propelling limit under its own weight.

As set forth above, as the screw spring 40 is provided, detachment of the cartridge body 2 dissolves the interlocking between the female thread protuberance 44 of the screw spring 40 and the male thread 51 of the push rod 50, and renders the push rod 50 freely movable in the axial direction. Therefore, the mechanism for causing the push rod 50 to move to the backward propelling limit upon detachment of the cartridge body 2 can be simplified, and the push rod 50 can move to the backward propelling limit with higher reliability.

After the consumed cartridge body 2 is detached from the main body outer tube 30, a new cartridge body 2 is attached to revert to the state shown in FIG. 1.

Specifically, if the user screws the male thread 20*a* of the cartridge body 2 into the female thread 32 of the main body outer tube 30 while holding the cap 3, the screw spring 40 is compressed between the posterior end surface 26 of the cartridge body 2 and the upper end surface 35*a* of the main body outer tube 30.

The pair of plate spring parts 43 of the screw spring 40 bows toward the inner circumferential side in the shape of a waisted drum. Therefore, when the anterior end part 41 is compressed, the pair of plate spring parts 43 further bows and comes into contact with the shaft 55 of the push rod 50. At this time, the force of friction between the anterior end part 41 of the screw spring 40 and the posterior end surface 26 of the cartridge body 2 acts on the anterior end part 41. Consequently, the plate spring parts 43 of the screw spring 40 become twisted while clinging to the outer circumference of the push rod 50, and the female thread protuberance 44 interlocks with the male thread 51 of the push rod 50.

The foregoing first embodiment achieves the following effects.

As the screw spring 40 is provided, detachment of the cartridge body 2 dissolves the interlocking between the female thread protuberance 44 of the screw spring 40 and the male thread 51 of the push rod 50, and renders the push rod 50 freely movable in the axial direction. Therefore, the mechanism for causing the push rod 50 to move to the backward propelling limit upon detachment of the cartridge body 2 can be simplified, and the push rod 50 can move to the backward propelling limit with higher reliability.

The screw spring 40 is formed from a thin stainless plate, and has excellent durability and resilience. Therefore, the cartridge-type cosmetic container 1 can be used for a long period of time. Furthermore, as the replaceable cartridge body 2 is constituted only by three components, that is to say, the cap 3, the cartridge outer tube 20, and the holding member 10, it can be provided at low cost.

Figure 11:
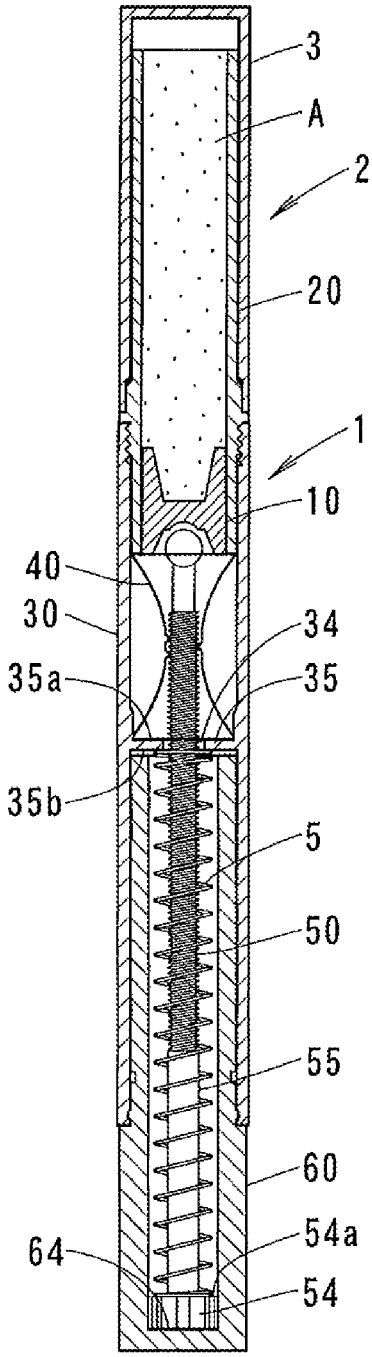
FIG. 11 is a frontal cross-sectional view of a cartridge-type cosmetic container according to a modification example of the first embodiment of the present invention.

In addition, as in a modification example shown in FIG. 11, the push rod 50 may be forcibly moved to the backward propelling limit upon detachment of the cartridge body 2 from the main body outer tube 30.

In this modification example, a return spring 5 is provided that pushes the push rod 50 back toward the backward propelling limit when the interlocking between the female thread protuberance 44 and the male thread 51 is dissolved upon detachment of the cartridge body 2 from the main body outer tube 30.

The return spring 5 is a coil spring that is stowed between a lower end surface 35*b* of the partition wall 35 of the main body outer tube 30 and an anterior end surface 54*a* of the large diameter part 54 of the push rod 50. The return spring 5 is compressed as the push rod 50 is propelled. When the interlocking between the female thread protuberance 44 of the screw spring 40 and the male thread 51 of the push rod 50 is dissolved, the return spring 5 pushes the push rod 50 back using its own pushing force, thereby causing the push rod 50 to move up until the backward propelling limit.

In this way, upon detachment of the cartridge body 2 from the main body outer tube 30, the pushing force of the return spring 5 causes the push rod 50 to be always positioned at the backward propelling limit.

Furthermore, even when the cartridge body 2 is not mounted, the push rod 50 is restrained in the axial direction and hence cannot freely advance and recede. This can prevent the push rod 50 from advancing against the user's intention.

In the case where the return spring 5 is provided, when the push rod 50 has moved up until the forward propelling limit, a clutch sound is produced that informs the user of the fact that the push rod 50 cannot be propelled any further. Specifically, if the user attempts to propel the push rod 50 when the push rod 50 is at the forward propelling limit, the female thread protuberance 44 runs over a portion of the shaft 55 where the male thread 51 is not formed. If the user attempts to further propel the push rod 50, the female thread protuberance 44 is pushed back to and interlocks with a posterior end portion of the male thread 51 again due to the resilient force of the return spring 5. At this time, a sound is produced by contact between the female thread protuberance 44 and the male thread 51.

In this way, the user can be informed of the fact that the push rod 50 is positioned at the propelling limit in the ascending direction. Therefore, the user can recognize the produced clutch sound as an indicator for replacement of the cartridge body 2.

Second Embodiment

The following describes a cartridge-type cosmetic container 101 according to a second embodiment of the present invention with reference to FIGS. 12A to 14B. It should be noted that, in the embodiments to be described below, the components that are similar to those of the above-described embodiment are given the same reference signs thereas, and redundant descriptions will be omitted as appropriate.

The cartridge-type cosmetic container 101 according to the second embodiment differs from its counterpart according to the first embodiment in the mechanism for attaching a cartridge body 102 to a main body outer tube 130.

Figure 12A:
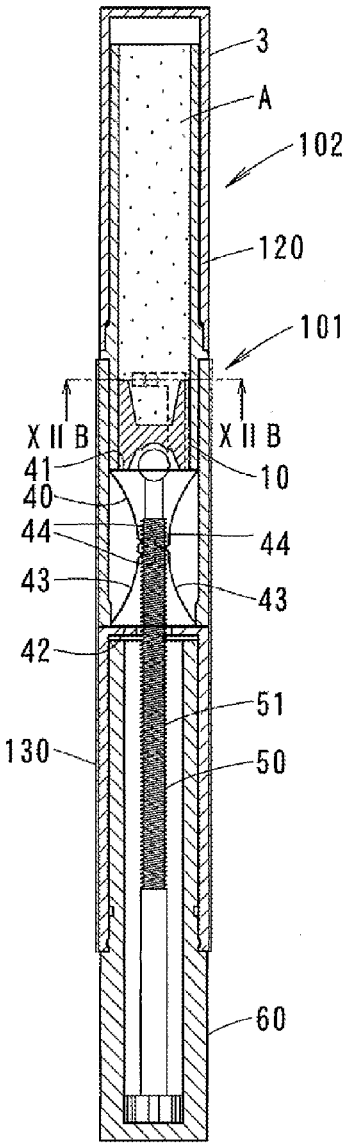
FIG. 12A is a frontal cross-sectional view of a cartridge-type cosmetic container according to a second embodiment of the present invention.

As shown in FIG. 12A, the cartridge-type cosmetic container 101 includes the main body outer tube 130, a driver body 60, a push rod 50, and a screw spring 40. The cartridge body 102 is detachably attached to the main body outer tube 130. The driver body 60 is coaxially attached to the main body outer tube 130 so as to be rotatable relative to the main body outer tube 130. A male thread 51 is formed on the outer circumference of the push rod 50. Relative rotations of the main body outer tube 130 and the driver body 60 propel the push rod 50, thereby causing the push rod 50 to push out a cosmetic substance A in the cartridge body 102. The screw spring 40 is housed in the main body outer tube 130, and pressed in an axial direction as a result of attaching the cartridge body 102.

The cartridge body 102 includes a cartridge outer tube 120, a holding member 10, and a cap 3. The cartridge outer tube 120 contains the cosmetic substance A. The holding member 10 is slidable in the axial direction in the cartridge outer tube 120. The cap 3 is attached to the cartridge outer tube 120.

Figure 13A:
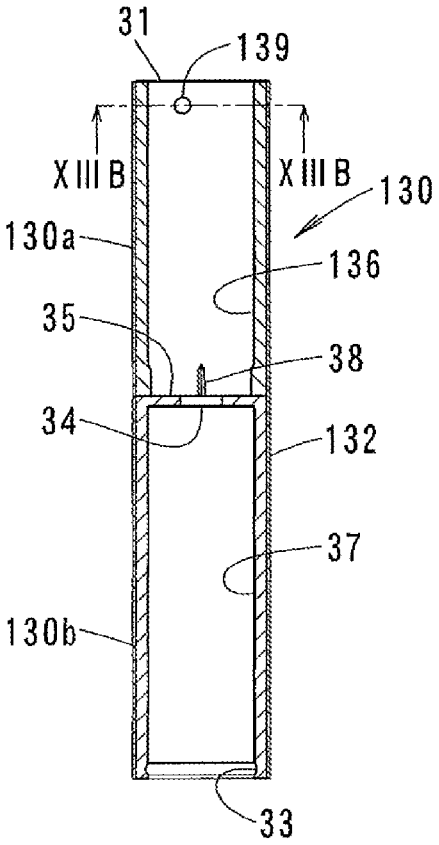
FIG. 13A is a frontal cross-sectional view of a main body outer tube.

As shown in FIG. 13A, the main body outer tube 130 includes an anterior inner tube 130*a*, a posterior inner tube 130*b*, and a metallic tube 132. The anterior inner tube 130*a* has a cylindrical shape, and an anterior cavity part 136 is formed on the inner circumference thereof. The posterior inner tube 130*b* has the shape of a cylinder with a bottom, and a posterior cavity part 37 is formed on the inner circumference thereof. The metallic tube 132 is mounted on the outer circumferences of the anterior inner tube 130*a* and the posterior inner tube 130*b* so as to integrate the anterior inner tube 130*a* and the posterior inner tube 130*b*. In the main body outer tube 130, a partition wall 35 that separates the anterior cavity part 136 and the posterior cavity part 37 from each other is a bottom surface of the posterior inner tube 130*b*. As the outer circumference of the main body outer tube 130 is covered by the metallic tube 132, the appearance and use of the main body outer tube 130 give the sense of profoundness and high grade.

Similarly to the main body outer tube 30 according to the first embodiment, the main body outer tube 130 includes a fitting recess 33, which is formed in the vicinity of an end portion of the posterior cavity part 37 and is joined to the driver body 60 so as to be rotatable relative to the driver body 60.

A later-described insert part 125 of the cartridge body 102 is inserted and fit into the anterior cavity part 136 from a distal end open hole 31. The screw spring 40 is also inserted into the anterior cavity part 136. A plurality of vertical ribs 38 whose end portions come into contact with the partition wall 35 are formed on the inner circumference of the anterior cavity part 136.

Figure 13B:
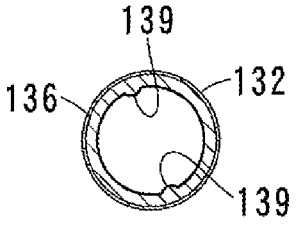
FIG. 13B is a cross-sectional view taken along the line XIIIB-XIIIB of FIG. 13A.

As shown in FIG. 13B, a pair of leading protuberances 139 is formed on the anterior cavity part 136. The leading protuberances 139 are not limited to being provided in a pair. Any number of leading protuberances 139 may be provided as long as the number is one or more. That is to say, at least one leading protuberance 139 is formed on the inner circumference of the main body outer tube 130.

Figure 14A:
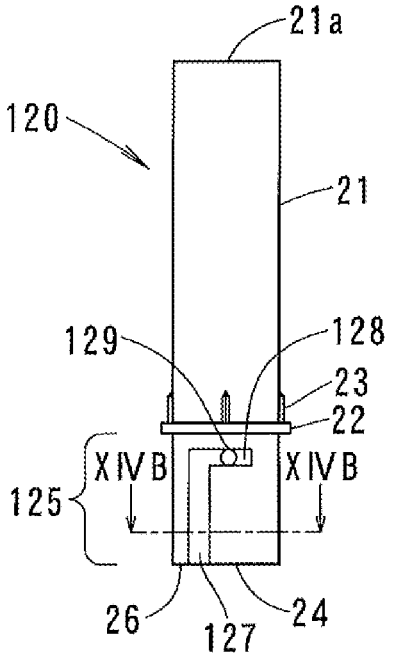
FIG. 14A is a front view of a cartridge outer tube.
Figure 14B:
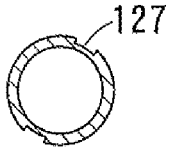
FIG. 14B is a cross-sectional view taken along the line XIVB-XIVB of FIG. 14A.

As shown in FIG. 14A, the cartridge outer tube 120 includes a cosmetic holding part 21, the insert part 125, and a flange 22. A distal end open hole 21*a* is formed in the cosmetic holding part 21. A posterior end open hole 24 is formed in the insert part 125. When attached to the main body outer tube 130, the insert part 125 is inserted and fit into the cartridge body 102. The flange 22 is provided between the cosmetic holding part 21 and the insert part 125, and projects toward the outer circumferential side.

The insert part 125 is formed in a cylindrical shape. The inner circumference of the insert part 125 is formed continuously with the inner circumference of the cosmetic holding part 21. Vertical grooves 127 and horizontal grooves 128 are formed on the outer circumference of the insert part 125. The leading protuberances 139 slide in the vertical grooves 127 when the insert part 125 is inserted into the main body outer tube 130 in the axial direction. After the insertion in the axial direction, the leading protuberances 139 slide in the horizontal grooves 128 when the insert part 125 is rotated in the circumferential direction with respect to the main body outer tube 130. Each vertical groove 127 is formed continuously with the corresponding horizontal groove 128 such that they form the shape of L. A pair of the vertical groove 127 and the horizontal groove 128 is provided at each of the positions corresponding to the leading protuberances 139.

The vertical grooves 127 are formed such that the width thereof is larger than the outer diameter of the leading protuberances 139. This allows the leading protuberances 139 to easily engage with the vertical grooves 127 when attaching the cartridge body 102.

The horizontal grooves 128 are formed such that the width thereof is substantially the same as the outer diameter of the leading protuberances 139. Furthermore, lock protuberances 129 are provided as protrusions in end portions of the horizontal grooves 128. The lock protuberances 129 hold the leading protuberances 139 and define the positions of the cartridge body 102 and the main body outer tube 130 in the circumferential direction. Each lock protuberance 129 is formed in a position that is apart from the end portion of the corresponding horizontal groove 128 by a distance equivalent to the outer diameter of the leading protuberances 139.

In order to attach the cartridge body 102 to the main body outer tube 130, first, the insert part 125 of the cartridge body 102 is inserted into the anterior cavity part 136 of the main body outer tube 130. At this time, positional alignment is performed in the circumferential direction in advance such that the leading protuberances 139 engage with the vertical grooves 127.

In the state where the leading protuberances 139 have engaged with the vertical grooves 127, if the cartridge body 102 is pushed into the main body outer tube 130, the leading protuberances 139 slide in the vertical grooves 127, and the screw spring 40 housed in the anterior cavity part 136 is compressed by being pressed in the axial direction. Consequently, plate spring parts 43 are pressed in the axial direction and bow toward the inner circumferential side, and a female thread protuberance 44 interlocks with the male thread 51 of the push rod 50.

Figure 12B:
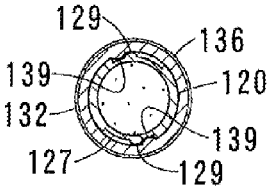
FIG. 12B is a cross-sectional view taken along the line XIIB-XIIB of FIG. 12A.

In the state where the cartridge body 102 has been pushed into the main body outer tube 130, if the cartridge body 102 is rotated with respect to the main body outer tube 130, the leading protuberances 139 slide in the horizontal grooves 128. Then, as shown in FIG. 12B, the leading protuberances 139 run over the lock protuberances 129 provided in the horizontal grooves 128. Consequently, the leading protuberances 139 are held in the end portions of the horizontal grooves 128, and the positions of the cartridge body 102 and the main body outer tube 130 in the circumferential direction are defined.

At this time, the force of friction between an anterior end part 41 of the screw spring 40 and a posterior end surface 26 of the cartridge body 102 acts on the anterior end part 41, thereby twisting the plate spring parts 43 of the screw spring 40. Consequently, the plate spring parts 43 of the screw spring 40 become twisted while clinging to the outer circumference of the push rod 50, and the female thread protuberance 44 is screwed with a strong screw force.

Similarly to the first embodiment, according to the foregoing second embodiment, as the screw spring 40 is provided, detachment of the cartridge body 102 dissolves the interlocking between the female thread protuberance 44 of the screw spring 40 and the male thread 51 of the push rod 50, and renders the push rod 50 freely movable in the axial direction. Therefore, the mechanism for causing the push rod 50 to move to a backward propelling limit upon detachment of the cartridge body 102 can be simplified, and the push rod 50 can move to the backward propelling limit with higher reliability.

Third Embodiment

The following describes a cartridge-type cosmetic container 301 according to a third embodiment of the present invention with reference to FIGS. 15A to 18C.

The cartridge-type cosmetic container 301 according to the third embodiment differs from its counterparts according to the above-described embodiments in that a female thread protuberance 44 interlocks with a male thread 51 of a push rod 50 even without pressing a screw spring 340 in the axial direction when attaching a cartridge body 302.

Figure 15A:
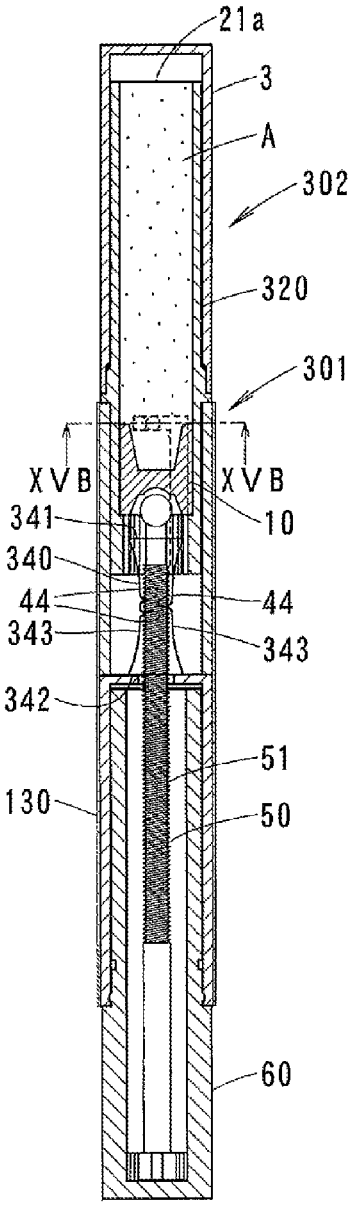
FIG. 15A is a frontal cross-sectional view of a cartridge-type cosmetic container according to a third embodiment of the present invention.
Figure 15B:
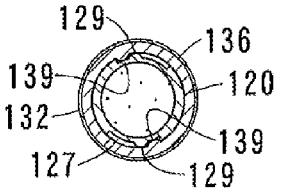
FIG. 15B is a cross-sectional view taken along the line XVB-XVB of FIG. 15A.

As shown in FIG. 15A, the cartridge-type cosmetic container 301 includes a main body outer tube 130, a driver body 60, a push rod 50, and a screw spring 340. The cartridge body 302 is detachably attached to the main body outer tube 130. The driver body 60 is coaxially attached to the main body outer tube 130 so as to be rotatable relative to the main body outer tube 130. The male thread 51 is formed on the outer circumference of the push rod 50. Relative rotations of the main body outer tube 130 and the driver body 60 propel the push rod 50, thereby causing the push rod 50 to push out a cosmetic substance A in the cartridge body 302. The screw spring 340 is housed in the main body outer tube 130. As a result of attaching the cartridge body 302, the screw spring 340 contracts in the axial direction and becomes twisted.

Figure 16A:
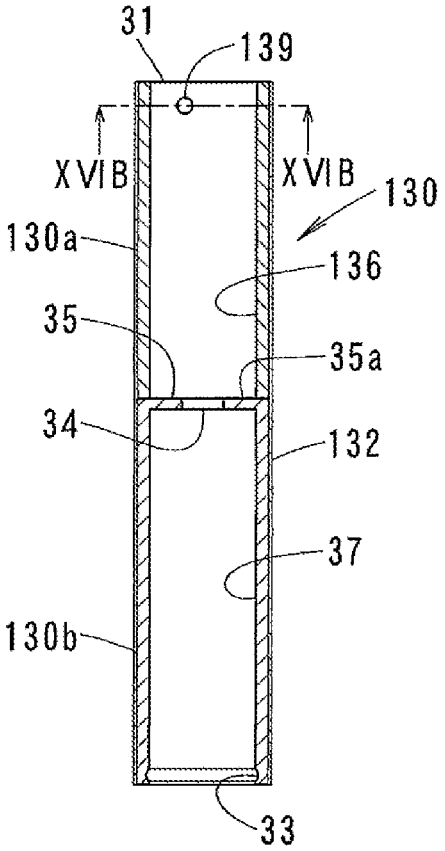
FIG. 16A is a frontal cross-sectional view of a main body outer tube.
Figure 16B:
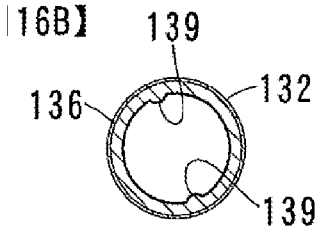
FIG. 16B is a cross-sectional view taken along the line XVIB-XVIB of FIG. 16A.

As shown in FIG. 16A, the main body outer tube 130 includes an anterior inner tube 130*a*, a posterior inner tube 130*b*, and a metallic tube 132. The anterior inner tube 130*a* has a cylindrical shape, and an anterior cavity part 136 is formed on the inner circumference thereof. The posterior inner tube 130*b* has the shape of a cylinder with a bottom, and a posterior cavity part 37 is formed on the inner circumference thereof. The metallic tube 132 is mounted on the outer circumferences of the anterior inner tube 130*a* and the posterior inner tube 130*b* so as to integrate the anterior inner tube 130*a* and the posterior inner tube 130*b*. A pair of leading protuberances 139 is formed on the anterior cavity part 136. In the present third embodiment, vertical ribs are not provided on the inner circumference of the anterior cavity part 136 of the main body outer tube 130.

Figure 17A:
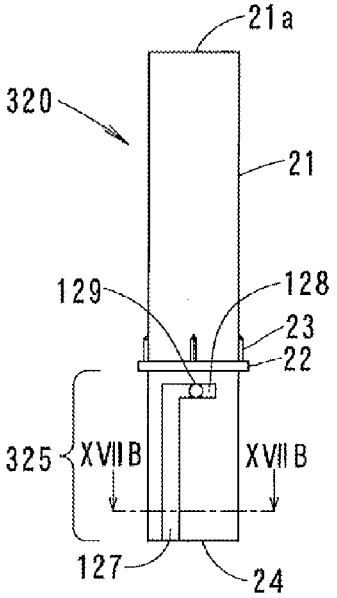
FIG. 17A is a front view of a cartridge outer tube.
Figure 17B:
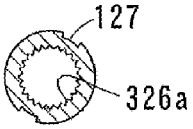
FIG. 17B is a cross-sectional view taken along the line XVIIB-XVIIB of FIG. 17A.
Figure 17C:
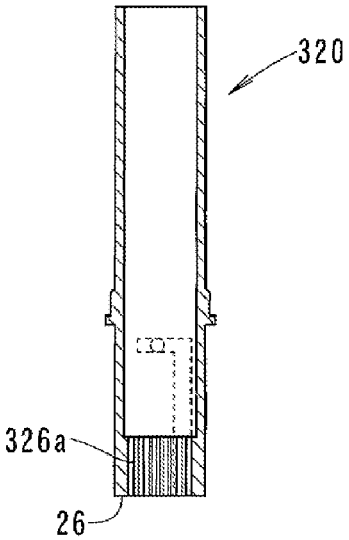
FIG. 17C is a cross-sectional view related to FIG. 17A.

As shown in FIG. 17A, a cartridge outer tube 320 includes a cosmetic holding part 21, an insert part 325, and a flange 22. A distal end open hole 21*a* is formed in the cosmetic holding part 21. A posterior end open hole 24 is formed in the insert part 325. When attached to the main body outer tube 130, the insert part 325 is inserted and fit into the anterior cavity part 136 of the main body outer tube 130. The flange 22 is provided between the cosmetic holding part 21 and the insert part 325, and projects toward the outer circumferential side.

The insert part 325 is formed in a cylindrical shape. The inner circumference of the insert part 325 is formed continuously with the inner circumference of the cosmetic holding part 21. Vertical knurls 326*a* are formed on the inner circumference of the posterior end open hole 24 of the insert part 325 opposing a posterior end surface 26.

Later-described protuberance parts 345 formed on an anterior end part 341 of the screw spring 340 engage with the vertical knurls 326*a*. The vertical knurls 326*a* are formed so as to be longer than the length of contraction of the screw spring 340 in the axial direction caused by the attachment of the cartridge body 302.

Vertical grooves 127 and horizontal grooves 128 are formed on the outer circumference of the insert part 325. The leading protuberances 139 slide in the vertical grooves 127 when the insert part 325 is inserted into the main body outer tube 130 in the axial direction. After the insertion in the axial direction, the leading protuberances 139 slide in the horizontal grooves 128 when the insert part 325 is rotated in the circumferential direction with respect to the main body outer tube 130.

Figure 18A:
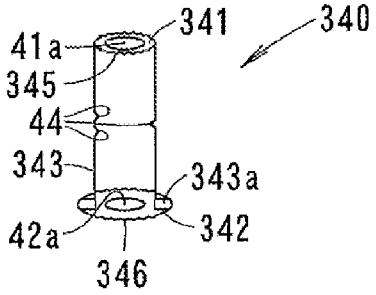
FIG. 18A is a perspective view of a screw spring.
Figure 18B:
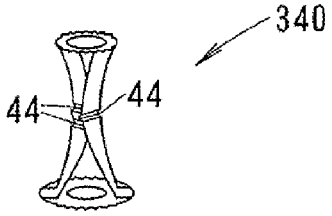
FIG. 18B is a perspective view showing the state where the screw spring has been installed in the cartridge-type cosmetic container.

As shown in FIG. 18A, the screw spring 340 is formed in the shape of a waisted drum. The screw spring 340 includes the anterior end part 341, a posterior end part 342, a plurality of plate spring parts 343, and the female thread protuberance 44. The anterior end part 341 engages with the cartridge body 302. The posterior end part 342 is supported by the main body outer tube 130. The plurality of plate spring parts 343 join the anterior end part 341 and the posterior end part 342 to each other. The female thread protuberance 44 is provided on at least one of the plurality of plate spring parts 343, and interlocks with the male thread 51 as the plate spring parts 343 curve toward the push rod 50.

Figure 18C:
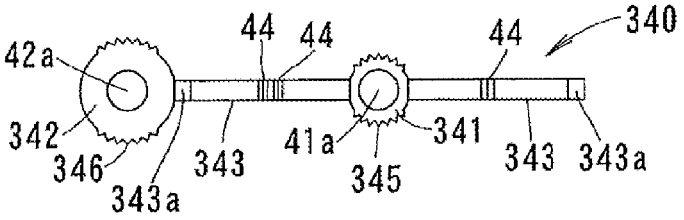
FIG. 18C is a developed view of the screw spring.

The anterior end part 341 is formed in an annular shape. As shown in FIG. 18C, the plurality of protuberance parts 345 that engage with the vertical knurls 326*a* are formed on the outer circumference of the anterior end part 341. It is sufficient to form at least one protuberance part 345 on the outer circumference of the anterior end part 341. A through-hole 41*a* through which a shaft 55 of the push rod 50 can advance and recede is formed in the middle of the anterior end part 341.

The posterior end part 342 is formed in an annular shape to have a larger diameter than the anterior end part 341. As shown in FIG. 18C, a plurality of protuberance parts 346 for fixing the screw spring 340 to the anterior cavity part 136 of the main body outer tube 130 are formed on the outer circumference of the posterior end part 342. A through-hole 42*a* through which the shaft 55 of the push rod 50 can advance and recede is formed in the middle of the posterior end part 342. The posterior end part 342 comes into contact with an upper end surface 35*a* (see FIG. 16A) in the anterior cavity part 136.

The protuberance parts 346 are formed such that the outer diameter thereof is slightly larger than the inner diameter of the anterior cavity part 136. In this way, once the screw spring 340 has been inserted into the anterior cavity part 136, the protuberance parts 346 are wedged inside the inner circumference of the anterior cavity part 136. Therefore, the posterior end part 342 of the screw spring 340 is fixed to the inner circumference of the anterior cavity part 136 such that it can neither move in the axial direction nor rotate.

As shown in FIG. 18C, folded parts 343*a* are provided to the plate spring parts 343 at portions joined to the posterior end part 342. The folded parts 343*a* are folded back toward the inner circumferential side at the time of assembly. Therefore, in the state where the screw spring 340 has not contracted (the state of FIG. 18A), the plate spring parts 343 are parallel to each other. By thus providing the folded parts 343*a* to make the plate spring parts 343 parallel to each other, the female thread protuberance 44 of the screw spring 340 can interlock with the male thread 51 of the push rod 50 even in the case where the outer diameter of the anterior end part 341 is different from the outer diameter of the posterior end part 342.

It should be noted that the screw spring 340 is formed by preparing a thin stainless plate into the shape shown in a developed view of FIG. 18C, and by fixing the folded parts 343*a* to the posterior end part 342 by adhesion, brazing, welding, or the like.

In order to attach the cartridge body 302 to the main body outer tube 130, first, the insert part 325 of the cartridge body 302 is inserted into the anterior cavity part 136 of the main body outer tube 130. At this time, positional alignment is performed in the circumferential direction in advance such that the leading protuberances 139 engage with the vertical grooves 127.

In the state where the leading protuberances 139 have engaged with the vertical grooves 127, if the cartridge body 302 is pushed into the main body outer tube 130, the leading protuberances 139 slide in the vertical grooves 127. At this time, the protuberance parts 345 of the anterior end part 341 of the screw spring 340 housed in the anterior cavity part 136 slide along the vertical knurls 326*a*. In this state, the plate spring parts 343 have not contracted in the axial direction yet. Therefore, the female thread protuberance 44 has not interlocked with the male thread 51 of the push rod 50 yet.

In the state where the cartridge body 302 has been pushed into the main body outer tube 130, if the cartridge body 302 is rotated with respect to the main body outer tube 130, the leading protuberances 139 slide in the horizontal grooves 128. Then, the leading protuberances 139 run over lock protuberances 129 provided in the horizontal grooves 128. Consequently, the leading protuberances 139 are held in end portions of the horizontal grooves 128, and the positions of the cartridge body 302 and the main body outer tube 130 in the circumferential direction are defined.

At this time, the cartridge body 302 rotates with respect to the main body outer tube 130, and the anterior end part 341 of the screw spring 340 rotates in synchronization with the rotation of the vertical knurls 326*a*. Accordingly, the anterior end part 341 of the screw spring 340 rotates relative to the posterior end part 342.

As the plate spring parts 343 are twisted as a result of relative rotations of the anterior end part 341 and the posterior end part 342, the total length of the screw spring 340 decreases. At this time, the posterior end part 342 is fixed to the inner circumference of the anterior cavity part 136, and hence cannot move in the axial direction. Therefore, the protuberance parts 345 of the anterior end part 341 slide along the vertical knurls 326*a*, and the anterior end part 341 approaches the posterior end part 342. In this way, the screw spring 340 contracts in the axial direction and becomes twisted without being pressed in the axial direction.

As set forth above, when the leading protuberances 139 slide in the horizontal grooves 128, the screw spring 340 contracts while being twisted as a result of rotation of the anterior end part 341 with respect to the posterior end part 342. Consequently, the plate spring parts 343 of the screw spring 340 become twisted while clinging to the outer circumference of the push rod 50, and the female thread protuberance 44 and the male thread 51 of the push rod 50 are screwed together.

Similarly to the above-described embodiments, according to the foregoing third embodiment, as the screw spring 340 is provided, detachment of the cartridge body 302 dissolves the interlocking between the female thread protuberance 44 of the screw spring 340 and the male thread 51 of the push rod 50, and renders the push rod 50 freely movable in the axial direction. Therefore, the mechanism for causing the push rod 50 to move to a backward propelling limit upon detachment of the cartridge body 302 can be simplified, and the push rod 50 can move to the backward propelling limit with higher reliability.

Fourth Embodiment

The following describes a cartridge-type cosmetic container 401 according to a fourth embodiment of the present invention with reference to FIGS. 19 to 23.

The cartridge-type cosmetic container 401 according to the fourth embodiment differs from its counterparts according to the above-described embodiments in that a screw spring 440 is used in place of the screw spring 40. In this screw spring 440, a posterior end part 442 is made up of a plurality of plate members 442*a*.

Figure 19:
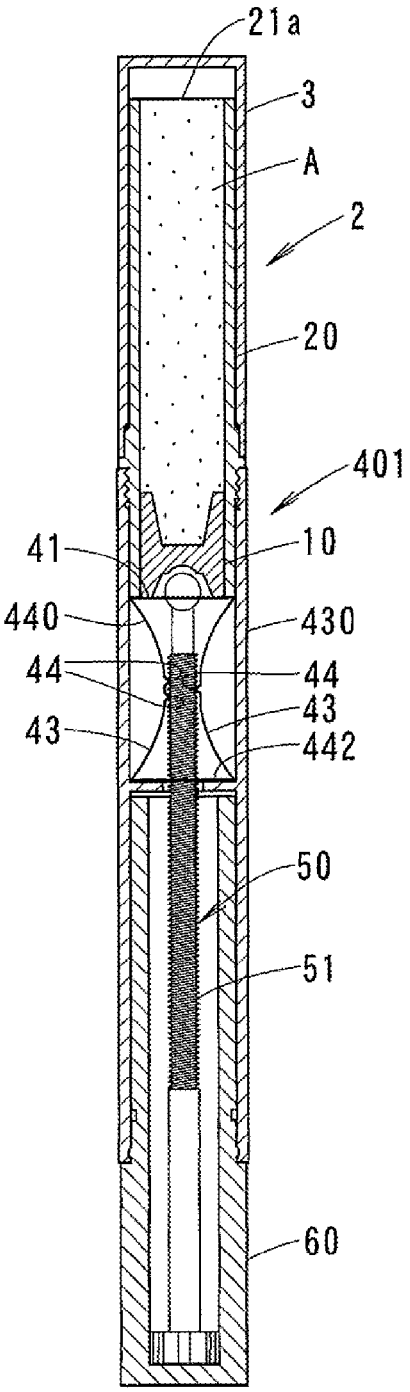
FIG. 19 is a frontal cross-sectional view of a cartridge-type cosmetic container according to a fourth embodiment of the present invention.

As shown in FIG. 19, the cartridge-type cosmetic container 401 includes a main body outer tube 430, a driver body 60, a push rod 50, and the screw spring 440. A cartridge body 2 is detachably attached to the main body outer tube 430. The driver body 60 is coaxially attached to the main body outer tube 430 so as to be rotatable relative to the main body outer tube 430. A male thread 51 is formed on the outer circumference of the push rod 50. Relative rotations of the main body outer tube 430 and the driver body 60 propel the push rod 50, thereby causing the push rod 50 to push out a cosmetic substance A in the cartridge body 2. The screw spring 440 is housed in the main body outer tube 430, and contracts in the axial direction as a result of attaching the cartridge body 2.

Figure 20:
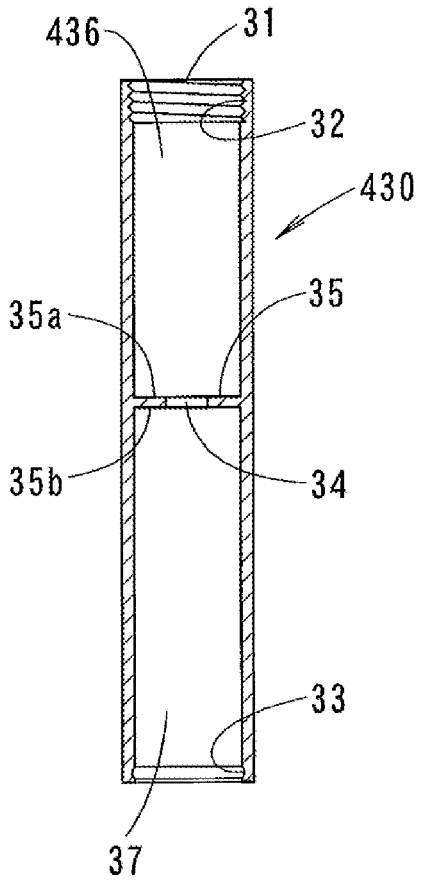
FIG. 20 is a frontal cross-sectional view of a main body outer tube.

As shown in FIG. 20, the main body outer tube 430 is formed in a cylindrical shape. The inner circumference of the main body outer tube 430 is separated into an anterior cavity part 436 and a posterior cavity part 37 by a partition wall 35 provided substantially in the middle in the axial direction. A through-hole 34 through which a shaft 55 of the push rod 50 can advance and recede is formed at the center of this partition wall 35.

The main body outer tube 430 includes a female thread 32 and a fitting recess 33. The female thread 32 is formed on the inner circumference in the vicinity of a distal end open hole 31 that is formed in an end portion of the anterior cavity part 436. The fitting recess 33 is formed in the vicinity of an end portion of the posterior cavity part 37, and is joined to the driver body 60 so as to be rotatable relative to the driver body 60.

An insert part 25 of the foregoing cartridge body 2 is inserted and fit into the anterior cavity part 436 from the distal end open hole 31. By rotating the main body outer tube 430 and the cartridge body 2 relative to each other about the central axis, a male thread 20*a* formed on a cartridge outer tube 20 of the cartridge body 2 is screwed into the female thread 32 of the main body outer tube 430. In this way, the cartridge body 2 is screwed and attached to the main body outer tube 430.

The screw spring 440 is also inserted into the anterior cavity part 436. The plurality of vertical ribs 38 that are formed on the main body outer tube 30 according to the first embodiment are not formed on the inner circumference of the anterior cavity part 436. Once the screw spring 440 has been inserted into the anterior cavity part 436, the screw spring 440 is held in the anterior cavity part 436 by the force exerted by the later-described posterior end part 442 to widen toward the outer circumferential side. Therefore, the screw spring 440 does not come off the anterior cavity part 436 even if the cartridge body 2 is detached.

The fitting recess 33 is provided on the inner circumference of the posterior cavity part 37 as an annular recess. A fitting protrusion 65 of the driver body 60 is fit into the fitting recess 33.

Figure 21A:
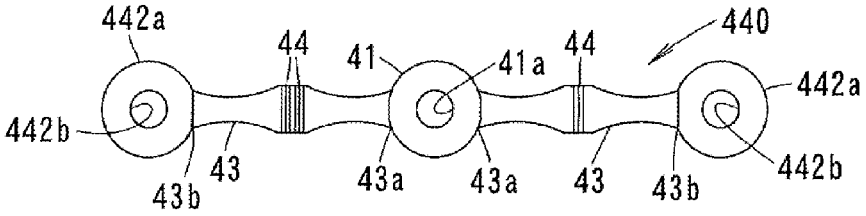
FIG. 21A is a developed view of a screw spring.
Figure 21B:
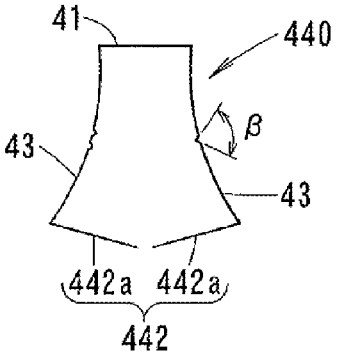
FIG. 21B is a front view of the screw spring.
Figure 21C:
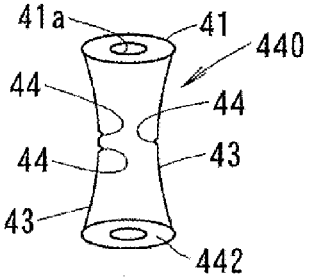
FIG. 21C is a perspective view of the screw spring.

As shown in FIG. 21C, the screw spring 440 is formed in the shape of a waisted drum. The screw spring 440 includes the posterior end part 442, an anterior end part 41, a plurality of plate spring parts 43, and a female thread protuberance 44. The posterior end part 442 serves as a first flat plate part whose position in the axial direction is defined in the main body outer tube 430. The anterior end part 41 serves as a second flat plate part that approaches the posterior end part 442 as a result of attaching the cartridge body 2. The plurality of plate spring parts 43 join the anterior end part 41 and the posterior end part 442 to each other. The female thread protuberance 44 is provided on at least one of the plurality of plate spring parts 43, and interlocks with the male thread 51 as the plate spring parts 43 curve toward the push rod 50.

The posterior end part 442 is made up of the plurality of plate members 442*a*, each of which is formed continuously with the corresponding plate spring part 43. The posterior end part 442 comes into contact with an upper end surface 35*a* (see FIG. 20) in the anterior cavity part 436.

The plate members 442*a* are formed in an annular shape similar to the shape of the anterior end part 41. The plate members 442*a* are formed such that the outer diameter thereof is smaller than the inner diameter of the anterior cavity part 436 of the main body outer tube 430. The plurality of plate members 442*a* are formed in a circular shape, have a through-hole 442*b* through which the shaft 55 is inserted at the center thereof, and are installed such that they are stacked in the axial direction.

As shown in FIG. 21A, one end 43*a* of each plate spring part 43 is formed continuously with the anterior end part 41, and the plurality of plate members 442*a* of the posterior end part 442 are formed continuously with the other ends 43*b* of the plate spring parts 43. The screw spring 440 is formed by bending a piece of thin plate shown in FIG. 21A. In this way, there is no need to join the plate members 442*a* to each other by adhesion, welding, and the like. It is thus easy to form the screw spring 440.

The screw spring 440 is formed such that the angle formed by each plate spring part 43 with respect to the anterior end part 41 at one end 43*a* is larger in the state where the screw spring 440 is not housed in the main body outer tube 430 (the state shown in FIG. 21B) than in the state where the screw spring 440 is housed in the main body outer tube 430 (the state shown in FIG. 21C).

The screw spring 440 is housed in the main body outer tube 430 while being compressed in the direction in which the other ends 43*b* of the plate spring parts 43 approach each other. That is to say, compared to the state where the screw spring 440 is not housed in the main body outer tube 430, the angle formed by each plate spring part 43 with respect to the anterior end part 41 at one end 43*a* is reduced when the screw spring 440 is housed in the main body outer tube 430. In this way, once the screw spring 440 has been inserted into the anterior cavity part 436 of the main body outer tube 430, the other end 43*b* of each plate spring part 43 acts to widen toward the outer circumferential side due to the resilient force at one end 43*a*. The screw spring 440 is held in the anterior cavity part 436 due to the plate members 442*a* being pushed against the inner circumference of the anterior cavity part 436.

The female thread protuberance 44 is provided as a protrusion on the inner side of the plate spring parts 43 substantially in the middle in the axial direction. It is preferable that, as shown in FIG. 21B, the angle β [deg] of the depression of the female thread protuberance 44 be larger than the angle that does not allow the plate spring parts 43 to bend, and be equal to or smaller than 80 [deg]. The female thread protuberance 44 interlocks with the male thread 51 more firmly in the case where the angle β is equal to or smaller than 80 [deg] than in the case where the angle β is larger than 80 [deg]. Therefore, even if the push rod 50 is pressed in the axial direction when the cosmetic substance A is used by the user, the chances are low that the interlocking between the male thread 51 and the female thread protuberance 44 is dissolved.

Figure 21D:
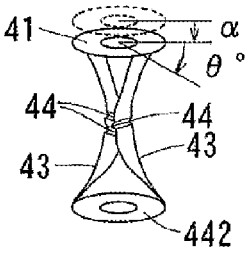
FIG. 21D is a perspective view showing the state where the screw spring has been installed in the cartridge-type cosmetic container.

As shown in FIG. 21D, the screw spring 440 is compressed by α [mm] and twisted by θ [deg] for use. It should be noted that no limitation is intended in this regard. The female thread protuberance 44 may interlock with the male thread 51 for use in the state where the plate spring parts 43 of the screw spring 440 are not twisted but merely bow toward the inner circumferential side by being pressed in the axial direction with a compression of α [mm].

As set forth above, in the screw spring 440, the posterior end part 442 is supported by the main body outer tube 430 such that it cannot turn, and the anterior end part 41 is rotated with respect to the posterior end part 442 by rotation of the cartridge body 2 relative to the main body outer tube 430. Consequently, the plate spring parts 43 become twisted, thereby making the female thread protuberance 44 of the plate spring parts 43 interlock with the male thread 51 of the push rod 50.

It should be noted that the screw spring 440 may be housed in the anterior cavity part 436 upside down such that the anterior end part 41 comes into contact with the upper end surface 35*a* in the anterior cavity part 436 and the posterior end part 442 comes into contact with the posterior end surface 26 of the cartridge body 2. In this case, the anterior end part 41 and the posterior end part 442 serve as the first flat plate part and the second flat plate part, respectively.

The operations of the cartridge-type cosmetic container 401 will now be described mainly with reference to FIGS. 22 and 23.

Figure 22:
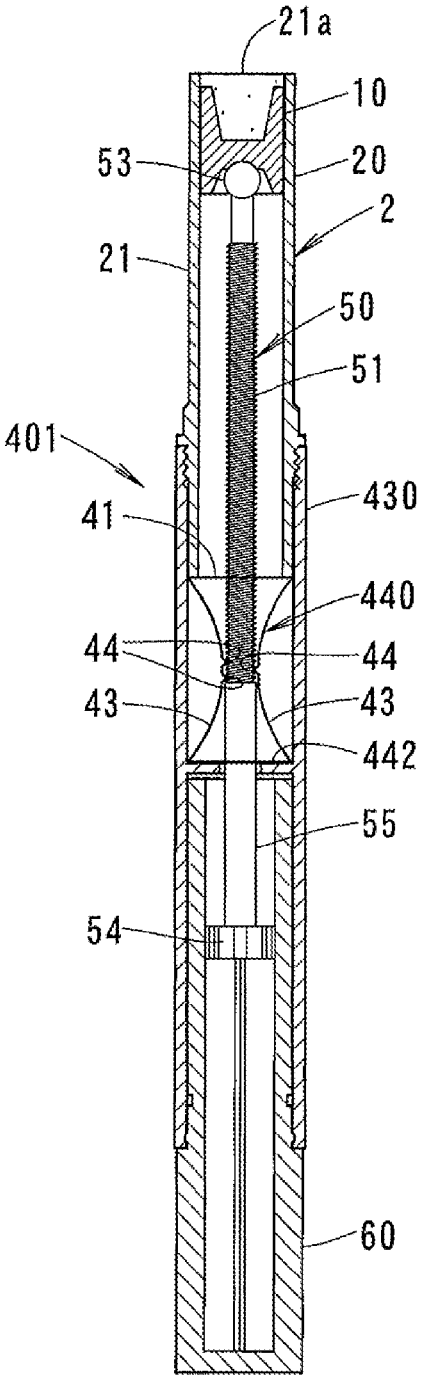
FIG. 22 shows the state where a push rod has been propelled up until a forward propelling limit in the cartridge-type cosmetic container shown in FIG. 19.
Figure 23:
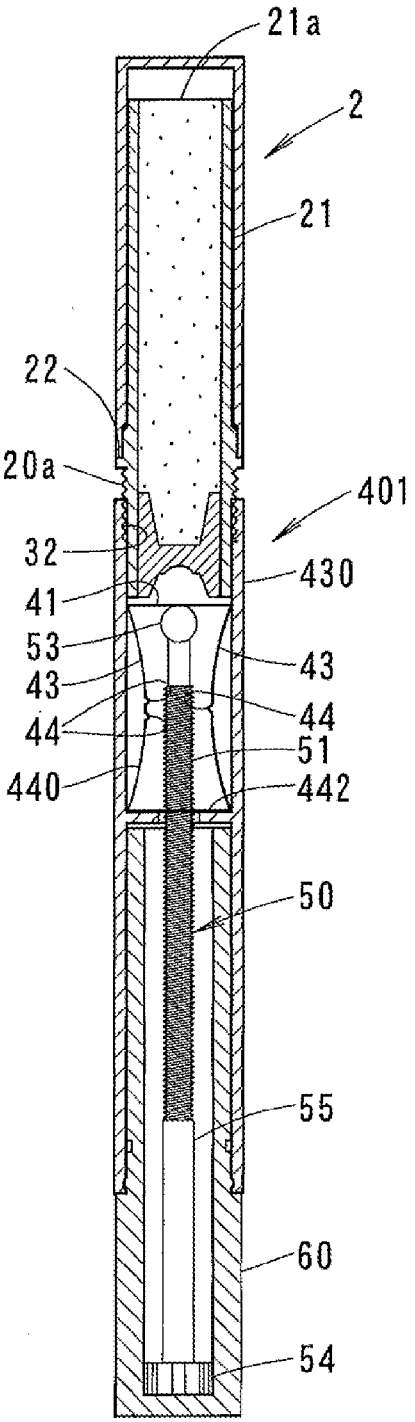
FIG. 23 shows the state where a cartridge body has been detached from the cartridge-type cosmetic container shown in FIG. 19.

In the state shown in FIG. 22, if the cartridge body 2 is rotated with respect to the main body outer tube 430 in an attempt to detach the cartridge body 2 from the main body outer tube 430, the cartridge body 2 is separated from the main body outer tube 430. Consequently, as shown in FIG. 23, the screw spring 440 extends in the axial direction due to its own resilient force, and is restored to the original state. Therefore, the pair of plate spring parts 43 is separated from each other, and the interlocking between the female thread protuberance 44 of the screw spring 440 and the male thread 51 of the push rod 50 is dissolved. This renders the push rod 50 freely movable in the axial direction. In the state where the push rod 50 is standing almost upright, it moves up until a backward propelling limit under its own weight.

At this time, the screw spring 440 is housed in the main body outer tube 430 while being compressed in the direction in which the other ends 43*b* of the plate spring parts 43 approach each other. Accordingly, the plurality of plate members 442*a* that make up the posterior end part 442 act to separate from each other by moving toward the outer circumferential side. For this reason, the screw spring 440 is held in the main body outer tube 430 by the force exerted by the plurality of plate members 442*a* to adhere to the inner circumference of the main body outer tube 430, and is hence prevented from falling.

The foregoing fourth embodiment achieves the following effects.

As the screw spring 440 is provided, detachment of the cartridge body 2 dissolves the interlocking between the female thread protuberance 44 of the screw spring 440 and the male thread 51 of the push rod 50, and renders the push rod 50 freely movable in the axial direction. Therefore, the mechanism for causing the push rod 50 to move to the backward propelling limit upon detachment of the cartridge body 2 can be simplified, and the push rod 50 can move to the backward propelling limit with higher reliability.

Figure 24:
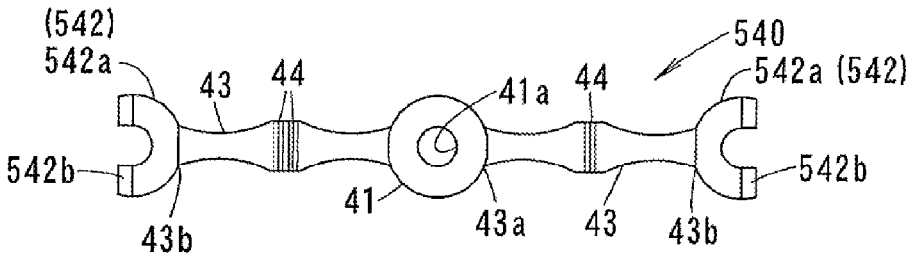
FIG. 24 is a developed view showing a first modification example of the screw spring.
Figure 25A:
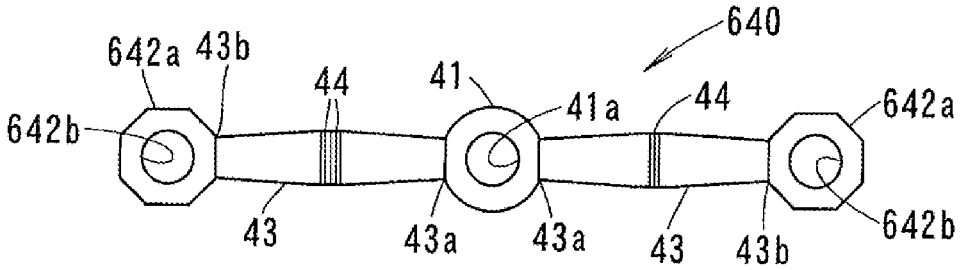
FIG. 25A is a developed view showing a second modification example of the screw spring.
Figure 25B:
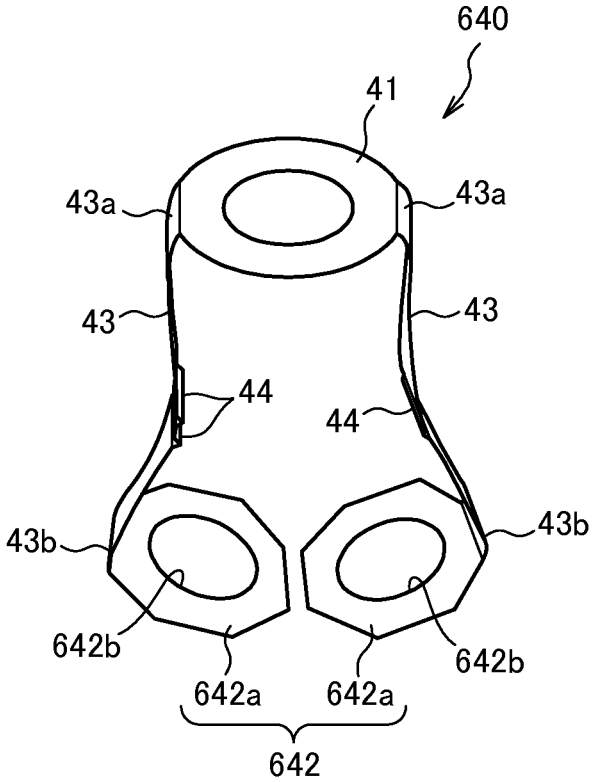
FIG. 25B is a perspective view of the second modification example of the screw spring.
Figure 26:
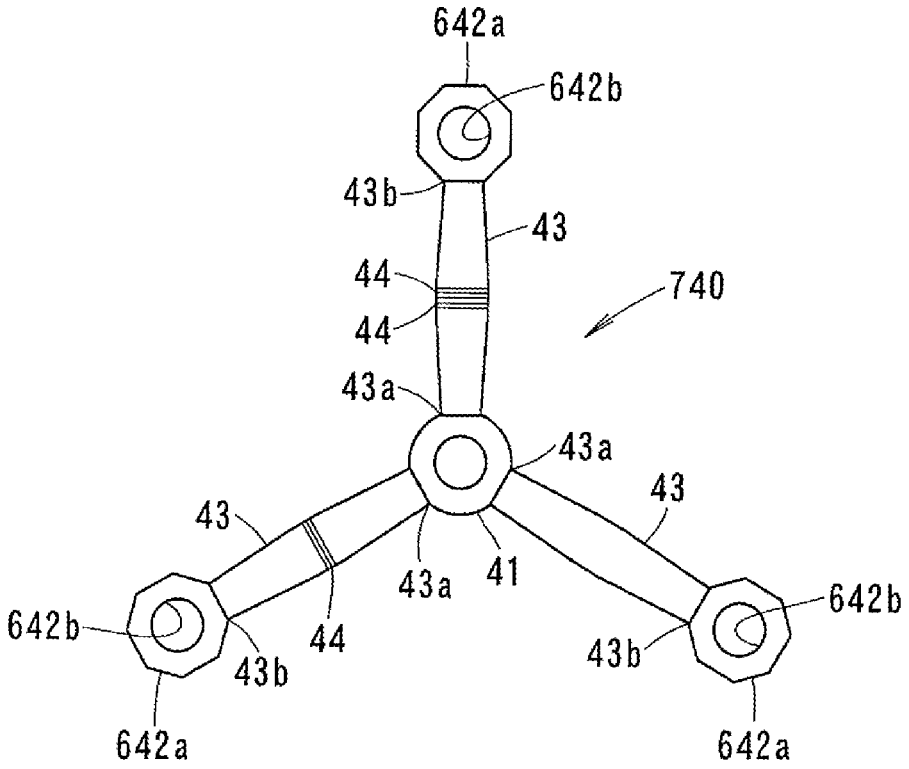
FIG. 26 is a developed view showing a third modification example of the screw spring.

With reference to FIGS. 24 to 26, the following describes screw springs 540, 640, and 740 according to the first to third modification examples of the embodiments of the present invention.

First, a description is given of the screw spring 540 according to the first modification example of the embodiments of the present invention with reference to FIG. 24.

The screw spring 540 includes a posterior end part 542, an anterior end part 41, a plurality of plate spring parts 43, and a female thread protuberance 44. The posterior end part 542 serves as a first flat plate part whose position in the axial direction is defined in the main body outer tube 430. The anterior end part 41 serves as a second flat plate part that approaches the posterior end part 542 as a result of attaching the cartridge body 2. The plurality of plate spring parts 43 join the anterior end part 41 and the posterior end part 542 to each other. The female thread protuberance 44 is provided on at least one of the plurality of plate spring parts 43, and interlocks with the male thread 51 as the plate spring parts 43 curve toward the push rod 50.

The posterior end part 542 is made up of a plurality of plate members 542*a*, each of which is formed continuously with the corresponding plate spring part 43. The posterior end part 542 comes into contact with the upper end surface 35*a* (see FIG. 20) in the anterior cavity part 436.

The plate members 542*a* are formed as a C-shaped flat plate. Each plate member 542*a* has a pair of free ends. Folded parts 542*b* that are folded back toward the anterior end part 41 are formed at these free ends. The plate members 542*a* are formed such that the outer diameter thereof is smaller than the inner diameter of the anterior cavity part 436 of the main body outer tube 430. The pair of plate members 542*a* is situated such that they face each other to form a circular shape together on the same plane, and the shaft 55 is inserted therebetween.

The screw spring 540 is housed in the main body outer tube 430 while being compressed in the direction in which the other ends 43*b* of the plate spring parts 43 approach each other. In this way, once the screw spring 540 has been inserted into the anterior cavity part 436, the screw spring 540 is held in the anterior cavity part 436 by the force exerted by the plurality of plate members 542*a* of the posterior end part 542 to widen toward the outer circumferential side.

In the case where the screw spring 540 is utilized, detachment of the cartridge body 2 similarly dissolves the interlocking between the female thread protuberance 44 of the screw spring 540 and the male thread 51 of the push rod 50, and renders the push rod 50 freely movable in the axial direction. Therefore, the mechanism for causing the push rod 50 to move to the backward propelling limit upon detachment of the cartridge body 2 can be simplified, and the push rod 50 can move to the backward propelling limit with higher reliability.

Next, a description is given of the screw spring 640 according to the second modification example of the embodiments of the present invention, and the screw spring 740 according to the third modification example of the embodiments of the present invention, with reference to FIGS. 25A to 26.

As shown in FIGS. 25A and 25B, the screw spring 640 includes a posterior end part 642, an anterior end part 41, a plurality of plate spring parts 43, and a female thread protuberance 44. The posterior end part 642 serves as a first flat plate part whose position in the axial direction is defined in the main body outer tube 430. The anterior end part 41 serves as a second flat plate part that approaches the posterior end part 642 as a result of attaching the cartridge body 2. The plurality of plate spring parts 43 join the anterior end part 41 and the posterior end part 642 to each other. The female thread protuberance 44 is provided on at least one of the plurality of plate spring parts 43, and interlocks with the male thread 51 as the plate spring parts 43 curve toward the push rod 50.

The posterior end part 642 is made up of a plurality of plate members 642*a*, each of which is formed continuously with the corresponding plate spring part 43. The posterior end part 642 comes into contact with the upper end surface 35*a* (see FIG. 20) in the anterior cavity part 436.

The plate members 642*a* are formed in a polygonal shape whose diameter is substantially the same as the diameter of the anterior end part 41. The plate members 642*a* are formed such that the outer diameter thereof is smaller than the inner diameter of the anterior cavity part 436 of the main body outer tube 430. The plurality of plate members 642*a* have a through-hole 642*b* through which the shaft 55 is inserted at the center thereof, and are installed such that they are stacked in the axial direction.

As the plate members 642*a* are formed in a polygonal shape, they can strongly engage with the inner circumference of the main body outer tube 430 compared to the plate members 442*a* formed in a circular shape. Therefore, when attaching the cartridge body 2, rotation of the screw spring 640 relative to the main body outer tube 430 can be prevented.

It is sufficient to form at least one of the plurality of plate members 642*a* in a polygonal shape. In addition, the plate members 642*a* are not limited to being formed in a polygonal shape. It is sufficient to form, on the outer circumferences of the plate members 642*a*, angular portions that engage with the inner circumference of the main body outer tube 430.

Furthermore, the plate spring parts 43 are not limited to being provided in a pair. Three or more plate spring parts 43 may be provided as in the screw spring 740 according to the third modification example shown in FIG. 26. In this manner, any number of plate spring parts 43 may be provided as long as the number is plural.

The screw spring 640 is housed in the main body outer tube 430 while being compressed in the direction in which the other ends 43*b* of the plate spring parts 43 approach each other. In this way, once the screw spring 640 has been inserted into the anterior cavity part 436, the screw spring 640 is held in the anterior cavity part 436 by the force exerted by the plurality of plate members 642*a* of the posterior end part 642 to widen toward the outer circumferential side.

In the case where the screw spring 640 is utilized, detachment of the cartridge body 2 similarly dissolves the interlocking between the female thread protuberance 44 of the screw spring 640 and the male thread 51 of the push rod 50, and renders the push rod 50 freely movable in the axial direction. Therefore, the mechanism for causing the push rod 50 to move to the backward propelling limit upon detachment of the cartridge body 2 can be simplified, and the push rod 50 can move to the backward propelling limit with higher reliability.

Embodiments of the present invention were described above, but the above embodiments are merely examples of applications of the present invention, and the technical scope of the present invention is not limited to the specific constitutions of the above embodiments.

The present application claims priority based on Japanese Patent Application No. 2012-221153 filed with the Japan Patent Office on Oct. 3, 2012 and Japanese Patent Application No. 2013-106319 filed with the Japan Patent Office on May 20, 2013, the entire contents of which are incorporated into this specification by reference.

The invention claimed is:

1. A cartridge-type cosmetic container being used with a cartridge body, containing a cosmetic substance, attached thereto, the cartridge-type cosmetic container comprising:

a main body outer tube to which the cartridge body is detachably attached;

a driver body that is coaxially attached to the main body outer tube so as to be rotatable relative to the main body outer tube;

a push rod with a male thread formed on an outer circumference thereof, the push rod pushing the cosmetic substance in the cartridge body by being propelled by relative rotations of the main body outer tube and the driver body; and a screw spring housed in the main body outer tube, and contracts in an axial direction as a result of attaching the cartridge body, wherein the screw spring includes:

a first flat plate part whose position in the axial direction is defined in the main body outer tube;

a second flat plate part that approaches the first flat plate part as a result of attaching the cartridge body;

a plurality of plate spring parts that join the first flat plate part and the second flat plate part to each other, and curve toward an inner circumferential side when contracting in the axial direction; and a female thread protuberance provided on at least one of the plurality of plate spring parts, and interlocks with the male thread as the plurality of plate spring parts curve.

2. The cartridge-type cosmetic container according to claim 1, wherein the cartridge body is attached to the main body outer tube by rotating about a central axis of the cartridge body, and the female thread protuberance interlocks with the male thread in a state where the plurality of plate spring parts are twisted while clinging to the outer circumference of the push rod due to the rotation of the cartridge body.

3. The cartridge-type cosmetic container according to claim 2, wherein the female thread protuberance is formed so as to incline in the same direction as a lead angle of the male thread when the plurality of plate spring parts are twisted.

4. The cartridge-type cosmetic container according to claim 1, wherein when the cartridge body is detached from the main body outer tube, the plurality of plate spring parts resume an original shape, and the interlocking between the female thread protuberance and the male thread is dissolved.

5. The cartridge-type cosmetic container according to claim 4, further comprising a return spring that pushes the push rod back toward a backward propelling limit when the interlocking between the female thread protuberance and the male thread is dissolved by the detachment of the cartridge body from the main body outer tube.

6. The cartridge-type cosmetic container according to claim 1, wherein the first flat plate part or the second flat plate part is made up of a plurality of plate members each of which is formed continuously with a corresponding one of the plurality of plate spring parts.

7. The cartridge-type cosmetic container according to claim 6, wherein the plurality of plate spring parts are formed such that one end of each plate spring part is continuous with one of the first flat plate part and the second flat plate part, and the plurality of plate members that make up the other of the first flat plate part and the second flat plate part are formed continuously with the other ends of the plurality of plate spring parts.

8. The cartridge-type cosmetic container according to claim 7, wherein the screw spring is housed in the main body outer tube while being compressed in a direction in which the other ends of the plurality of plate spring parts approach each other.

9. The cartridge-type cosmetic container according to claim 6, wherein the plurality of plate members are formed in a circular shape, have a through-hole through which the push rod is inserted at a center thereof, and are installed so as to be stacked in the axial direction.

10. The cartridge-type cosmetic container according to claim 6, wherein at least one of the plurality of plate members has an angular portion on an outer circumference thereof, the angular portion engaging with an inner circumference of the main body outer tube.

11. The cartridge-type cosmetic container according to claim 10, wherein at least one of the plurality of plate members is formed in a polygonal shape.

12. The cartridge-type cosmetic container according to claim 6, wherein the first flat plate part is made up of the plurality of plate members.

* * * * *